US007951452B2

(12) United States Patent
Nakayama et al.

(10) Patent No.: US 7,951,452 B2
(45) Date of Patent: May 31, 2011

(54) SUEDE ARTIFICIAL LEATHER AND PRODUCTION METHOD THEREOF

(75) Inventors: Kimio Nakayama, Okayama (JP); Tsuyoshi Yamasaki, Okayama (JP); Nobuo Takaoka, Okayama (JP); Mitsuru Kato, Okayama (JP); Shuhei Yorimitsu, Okayama (JP)

(73) Assignee: KURARAY Co., Ltd., Kurashiki-shi (JP)

( * ) Notice: Subject to any disclaimer, the term of this patent is extended or adjusted under 35 U.S.C. 154(b) by 25 days.

(21) Appl. No.: 10/670,212

(22) Filed: Sep. 26, 2003

(65) Prior Publication Data

US 2004/0063366 A1 Apr. 1, 2004

(30) Foreign Application Priority Data

Sep. 30, 2002 (JP) ..... 2002-286574

(51) Int. Cl.
*B32B 9/00* (2006.01)

(52) U.S. Cl. ..... 428/368; 428/904; 428/375

(58) Field of Classification Search ..... 428/364, 428/365, 368, 370, 375, 904; 442/334, 340, 442/374, 375, 376, 380
See application file for complete search history.

(56) References Cited

U.S. PATENT DOCUMENTS

| | | | | | |
|---|---|---|---|---|---|
| 3,419,533 | A | * | 12/1968 | Dieterich | 528/44 |
| 4,525,169 | A | * | 6/1985 | Higuchi et al. | 8/485 |
| 4,914,764 | A | * | 4/1990 | Mast et al. | 8/436 |
| 5,258,481 | A | * | 11/1993 | Hesselmans et al. | 528/28 |
| 5,338,613 | A | * | 8/1994 | Tomotsugu et al. | 428/425.8 |
| 5,969,015 | A | * | 10/1999 | Zinke et al. | 524/109 |
| 6,218,500 | B1 | * | 4/2001 | Keute et al. | 528/49 |
| 6,299,977 | B1 | * | 10/2001 | Takeyama et al. | 428/373 |
| 6,733,859 | B2 | * | 5/2004 | Yoneda et al. | 428/91 |
| 6,838,172 | B2 | * | 1/2005 | Yoon et al. | 428/370 |
| 2003/0232555 | A1 | * | 12/2003 | Nobuto et al. | 442/136 |

FOREIGN PATENT DOCUMENTS

| | | | |
|---|---|---|---|
| JP | 58-186678 | | 10/1983 |
| JP | 05-321159 | | 12/1993 |
| JP | 9-67779 | | 3/1997 |
| JP | 09059881 | * | 3/1997 |
| JP | 09059882 | * | 3/1997 |
| JP | 2001-279532 | | 10/2001 |
| JP | 2002-242079 | | 8/2002 |
| SU | 445303 | * | 5/1976 |
| SU | 445303 A | * | 5/1976 |

OTHER PUBLICATIONS

Patent Abstracts of Japan, JP 09-059881, Mar. 4, 1997.
Derwent Publications, AN 1994-013013, XP-002350811, JP 03-180230, Jun. 25, 2001.

* cited by examiner

*Primary Examiner* — D. Lawrence Tarazano
*Assistant Examiner* — Matthew D Matzek
(74) *Attorney, Agent, or Firm* — Oblon, Spivak, McClelland, Maier & Neustadt, L.L.P.

(57) ABSTRACT

The suede artificial leather of the present invention comprises a three-dimensional entangled body comprising a superfine fiber having a fineness of 0.2 dtex or less and an elastomeric polymer A, and satisfies the requirements (1) to (4) as specified in the specification. By meeting the requirements, the suede artificial leather acquires excellent color fastness to light and color development in a wide range of colors and a high quality with good suede feeling, surface touch, hand, mechanical properties and color fastness.

18 Claims, No Drawings

SUEDE ARTIFICIAL LEATHER AND PRODUCTION METHOD THEREOF

BACKGROUND OF THE INVENTION

1. Field of the Invention

The present invention relates to a suede artificial leather having excellent color fastness to light and color development in a wide variety of colors and having a high quality with a good suede feeling, surface touch and hand, and further relates to a semi-grained or grained artificial leather made of the suede artificial leather.

2. Description of the Prior Art

Suede artificial leathers comprising superfine fibers and an elastomeric polymer have been conventionally known. These suede artificial leathers made of superfine fibers are highly appreciated as materials analogous to natural leathers because of their excellent suede feeling and surface touch. To color the suede artificial leathers, dyes have been conventionally used.

However, the superfine fiber is much poor in the color development as compared with fibers of ordinary fineness because of its small fineness. Therefore, several to about 20 times amount of dye as compared with the fibers of ordinary fineness is required for the color development of the superfine fiber, this making the color fastness to rubbing and the color fastness to light of the superfine fibers poor. The elastomeric polymer contained in the suede artificial leathers is much poor in the color fastness to light as compare with the fiber, this being a major cause to deteriorate the color fastness to light of the suede artificial leather itself It has been conventionally considered to improve the color fastness to light of the dye itself, but there is a limit to the improvement. At present, a little is provided as suede materials which meet severe requirements of users in the applications requiring a long-term stability under severe conditions as in the case of car seats, etc. If any, the obtainable colors thereof are largely limited.

Although the strong demand continues for the artificial leathers excellent in the color development, the color fastness to light and the color fastness to rubbing in a wide variety of colors, the attempts to solve the problems by conventional approaches utilizing the color development of dyes has reached the limit.

To solve the problems, several coloring methods using pigments which are superior to dyes in the color fastness to light have been proposed. For example, Japanese Patent Publication No. 62-37252 discloses on pages 1-4 a method using superfine fibers colored by incorporating a pigment into a fiber-constituting polymer. Japanese Patent Application Laid-Open Nos. 5-331782 (pages 2-4) and 2000-45186 (pages 1-7) disclose methods for dying superfine fibers colored by incorporating a pigment into a polymer. Although the light resistance of fibers is improved by these methods, the improvement of the light resistance is limited because nothing is considered on preventing the deterioration in the light resistance of the elastomeric polymer. In addition, since no pigment is added to the elastomeric polymer, the elastomeric polymer is whitened to make the color difference between the fiber and the elastomeric polymer remarkable, thereby making it difficult to obtain suede artificial leathers with high quality. Pigments include organic pigments, carbon black and inorganic pigments. The proposed methods include a process where one of the components of superfine fiber-forming fibers is removed by an organic solvent or a process where the elastomeric polymer dissolved in a solvent is wet-coagulated in a liquid containing an organic solvent, each being employed in the conventional method for producing artificial leathers. As a result of the experiments made by the inventors, it was found that an organic pigment in superfine fiber-forming fibers was partly eluted into the organic solvent in the superfine fiber-forming process or the wet coagulation process. Therefore, carbon black and the inorganic pigments must be mainly used as the pigment in the industrial productions, this narrowing the range of obtainable colors and resulting in a poor color development and brilliantness.

In the method of Japanese Patent Publication No. 62-37252, it is attempted to attain a variety of colors by incorporating pigments only into the fiber. However, this method requires to switch the spinning apparatuses to increase the production loss, this making the method difficult to be industrially practiced. In addition, this method cannot attain a sufficient color development because of a poor color development of the superfine fibers. If a large amount of pigment is incorporated to enhance the color development, the spinning becomes difficult because of the clogging of filter and the increase in spinning pressure and the properties of the resultant fibers are largely deteriorated.

Other known color developing methods include a method where superfine fibers colored by incorporating a pigment such as carbon black into a fiber-constituting polymer are dyed, and a method where an elastomeric polymer colored by incorporating a pigment such as carbon black thereinto is dyed (for example, Japanese Patent Application Laid-Open Nos. 2002-146624 (pages 2-7) and 2001-279532 (pages 2-7)). The proposed methods intend to darken the color of substrate by making the developed color of dye blackish with carbon black, and the improvement of the color fastness to light by these methods is limited.

In another proposed method, a nonwoven fabric for forming superfine fibers is provided with an elastomeric polymer containing a pigment and then dyed (for example, Japanese Patent Application Laid-Open Nos. 63-315683 (pages 1-6) and 58-197389 (pages 1-4)). In these methods, the fastness to light is improved for the elastomeric polymer, but limited for the superfine fibers because they are colored only with dyes. In addition, the proposed methods include a process where one of the components of superfine fiber-forming fibers is removed by an organic solvent and a process where the elastomeric polymer dissolved in a solvent is wet-coagulated in a liquid containing an organic solvent, each being employed in the conventional method for producing artificial leathers. As a result of the experiments made by the inventors, it was found that an organic pigment in superfine fiber-forming fibers was partly eluted into the organic solvent in the superfine fiber-forming process or the wet coagulation process. Therefore, carbon black and the inorganic pigments must be mainly used as the pigment in the industrial productions, this narrowing the range of obtainable colors and resulting in a poor color development and brilliantness. Further, these methods are mainly intended to provide a nap-raised sheet with iridescent color tone or uneven pattern by utilizing the color difference between the fiber and the elastomeric polymer, which is different from the suede artificial leather intended by the present invention.

Further proposed are several methods where a fiber sheet is impregnated with an elastomeric polymer blended with a pigment having a low infrared absorbancy, and then dyed (for example, Japanese Patent Application Laid-Open Nos. 5-321159 (page 2), 7-42084 (page 2), 2002-242079 (page 2) and 2002-327377 (page 2)). In these methods, the elastomeric polymer is colored black by a low infrared-absorbing organic black pigment such as azomethineazo compounds and perylene compounds or the elastomeric polymer is colored to blackish color with a low chroma by a mixture of three organic pigments, in place of using carbon black which is easy to build up heat by the absorption of infrared ray. Thus, these methods are intended to make the elastomeric polymer into blackish color thereby to darken the color developed by dye. However, since the superfine fibers are colored only with dye, the improvement of the color fastness to light is limited. In any of the proposed methods, the solvent-type polyurethane blended with a pigment is wet-coagulated. As mentioned above, since the organic pigment in the elastomeric polymer is partly dissolved into the organic solvent in this process, the organic pigment is partly released to cause color variation and the switching loss is increased, thereby failing to attain industrially stable productivity. Further, the low infrared-absorbing organic pigment is quite expensive, this being unfavorable in view of production costs and limiting the usable pigments to make it difficult to obtain a wide variety of colors.

A coloring method by adsorption of pigment in a water bath, i.e., a pigment exhaustion coloring method is also proposed (for example, Japanese Patent Application Laid-Open Nos. 2001-248080 (pages 2-6) and 10-259579 (pages 2-5)). These methods provide a relatively good color fastness to light. However, since the pigment is fixed to the surface of fibers and elastomeric polymer and not embedded in fibers and elastomeric polymer, the pigment is easily released to likely deteriorate the fastness such as the color fastness to rubbing. Particularly in superfine fibers of 0.2 dtex or thinner, a large amount of pigment is required as in the case of dyeing to result in a deterioration of the fastness such as the color fastness to rubbing.

In summary, the proposed methods for coloring by pigments involves the following drawbacks.

(1) The methods employ a process where one of the components of superfine fiber-forming fibers is removed by an organic solvent and/or a process where the elastomeric polymer dissolved in a solvent is wet-coagulated in a liquid containing an organic solvent, each employed in the conventional method for producing artificial leather. Therefore, carbon black and the inorganic pigments must be mainly used as the pigment in industrial production, this limiting the range of obtanable colors and resulting in a poor color development and brilliantness. If organic pigments are used, the organic pigments are released in the processes using an organic solvent, failing to achieve an industrially stable productivity.

(2) Since pigments are incorporated into only one of fiber and elastomeric polymer, the methods bring about only a limited improvement to the color fastness to light, and also, bear problems in the color fastness to rubbing and the range of obtainable colors.

(3) The methods give substantially no consideration for the problems associated with the coloring by pigments, i.e., the deterioration in mechanical properties and various fastness such as the color fastness to rubbing. Therefore, it is hard to consider that the proposed methods are satisfactory in mechanical properties and fastness.

Thus, no suede artificial leather having excellent color fastness to light and color development in a wide variety of colors and also excellent in suede feeling, surface touch, hand, mechanical properties and various fastness has been industrially provided.

SUMMARY OF THE INVENTION

The present invention is intended to solve the above problems and provide a suede artificial leather having excellent color fastness to light and color development in a wide range of colors and having a high quality with good suede feeling, surface touch, hand, mechanical properties and various fastness, and further provide a semi-grained or grained artificial leather made of the suede artificial leather.

As a result of extensive study by the inventors for achieving the above objects, the present invention has been accomplished.

Thus, the present invention provides a suede artificial leather comprising a three-dimensional entangled body comprising a superfine fiber having a fineness of 0.2 dtex or less and an elastomeric polymer A, the suede artificial leather satisfying the following requirements (1) to (4):

(1) the three-dimensional entangled body contains at least one pigment A selected from the group consisting of an organic pigment having an average particle size of 0.01 to 0.3 μm and carbon black having an average particle size of 0.01 to 0.3 μm in an amount of 0 to 8% by mass;

(2) the elastomeric polymer A contains as a pigment B at least one pigment selected from the group consisting of an organic pigment having an average particle size of 0.05 to 0.6 μm and carbon black having an average particle size of 0.05 to 0.6 μm, or a pigment particle having an average particle size of 0.05 to 0.6 μm containing an organic pigment, in an amount of 1 to 20% by mass;

(3) the ratio of the elastomeric polymer A to the three-dimensional entangled body is 15:85 to 60:40 by mass; and (4) an average raised nap length of the superfine fiber present on the surface of the suede artificial leather is 10 to 200 μm.

The present invention further provides a method for producing a suede artificial leather comprising a three-dimensional entangled body comprising a superfine fiber having a fineness of 0.2 dtex or less and an elastomeric polymer, which comprises:

a step (I) for producing a fiber-entangled nonwoven fabric comprising a superfine fiber-forming fiber which comprises a thermoplastic component slightly soluble in water for forming the superfine fiber and a water-soluble thermoplastic polyvinyl alcohol copolymer component, the thermoplastic component slightly soluble in water containing at least one pigment A selected from the group consisting of an organic pigment having an average particle size of 0.01 to 0.3 μm and carbon black having an average particle size of 0.01 to 0.3 μm in an amount of 0 to 8% by mass;

a step (II) for impregnating the fiber-entangled nonwoven fabric with an aqueous dispersion containing a water-dispersed elastomeric polymer and a water-dispersed pigment B in an amount of 1 to 20% by mass of the water-dispersed elastomeric polymer such that a ratio of the elastomeric polymer derived from the water-dispersed elastomeric polymer to the three-dimensional entangled body is 15:85 to 60:40, the water-dispersed pigment B being at least one water-dispersed pigment selected from the group consisting of an water-dispersed organic pigment having an average particle size of 0.05 to 0.6 μm and water-dispersed carbon black having an average particle size of 0.05 to 0.6 μm, or a water-dispersed pigment particle having an average particle size of 0.05 to 0.6 μm containing an organic pigment; and a step (III) for removing the water-soluble thermoplastic polyvinyl alcohol copolymer component by extraction with an aqueous solution, thereby fibrillating the superfine fiber-forming fiber into the superfine fiber having a fineness of 0.2 dtex or less.

The present invention is based on the following findings.

(1) To achieve an excellent color development and color fastness to light, and a wide range of colors from brilliant color to achromatic color and from light color to deep color, it is required that both the superfine fiber and the elastomeric polymer contains pigments; that the average raised nap length of the surface superfine fiber is regulated within a relatively short range of 10 to 200 μm thereby to ensure and enhance the color development of the elastomeric polymer, and simultaneously, to obtain a wide range of colors by mixing the colors of the fiber and the elastomeric polymer; and that an organic pigment and/or carbon black is used in place of an inorganic pigment commonly used because excellent brilliantness and color development and a wide range of colors can be attained.

(2) Since an organic pigment is partly dissolved into an organic solvent, it is industrially effective for coloring the fiber and the elastomeric polymer with the organic pigment to fibrillate the superfine fiber-forming fiber in an aqueous solution without using an organic solvent and to use a water-dispersed elastomeric polymer.

(3) To solve the conventional problems associated with the addition of pigments, i.e., to avoid the deterioration in mechanical properties and color fastness to rubbing due to the addition of pigments, it is necessary to use the organic pigment and/or carbon black and to control the average particle sizes of the pigments to be incorporated into the superfine fiber and the elastomeric polymer within specific ranges.

(4) To produce a suede artificial leather with high quality having little color mottle in the pigmented superfine fiber and elastomeric polymer, it is required to incorporate the pigments into both the fiber and elastomeric polymer in a ratio by mass within a specific range, and to reduce the fineness of the superfine fiber.

(5) As a component to be removed from the pigmented superfine fiber-forming fiber by extraction, preferred is a water-soluble thermoplastic polyvinyl alcohol copolymer in view of the color development and flexibility.

(6) As the elastomeric polymer to be colored with pigment, an elastomeric polymer having a hot water swelling rate of a specific range or lower is preferred in view of enhancing the color development by preventing the pigment from being released; a transparent elastomeric polymer having a specific range of particle size is preferred in view of the color development when an water-dispersed elastomeric polymer is used; and an elastomeric polymer having a color fastness to light of 3rd rating or higher when evaluated using a xenon arc lamp is preferred for applications requiring a high color fastness to light.

DETAILED DESCRIPTION OF THE INVENTION

The present invention will be explained in more detail.

It is critical for the present invention that the superfine fiber contains an organic pigment having an average particle size of 0.01 to 0.3 μm and/or carbon black having an average particle size of 0.01 to 0.3 μm (hereinafter may be collectively referred to as "pigment A") in an amount of 0 to 8% by mass. The pigment A is preferably mixed with the superfine fiber-constituting polymer to form an integrated whole, and embedded mainly in the superfine fiber-constituting polymer. The words "the pigment A is mixed with the superfine fiber-constituting polymer to form an integrated whole, and embedded mainly in the superfine fiber-constituting polymer" referred to herein mean that the pigment A is substantially uniformly distributed throughout the superfine fiber-constituting polymer without separately and unevenly distributed from the superfine fiber-constituting polymer. The average particle size referred to herein is an average particle size of the pigment A present in the superfine fiber, and not a primary particle size. The pigment scarcely presents as primary particles, and generally presents as agglomerate consisting of a large number of primary particles, such as structure, primary agglomerate, secondary agglomerate and secondary particle. The state of agglomerate depends on the types of pigment and polymer, the spinning conditions, etc. and the particle size of the pigment in the form of agglomerate is considered to govern the various properties. The average particle size referred to herein is the average particle size of the pigment present in the polymer in the form of agglomerates such as structure, primary agglomerate, secondary agglomerate and secondary particle.

The average particle size of the pigment A in the superfine fiber is 0.01 to 0.3 μm. If exceeding 0.3 μm, the filter clogging is likely to occur in the spinning process to reduce the spinnability. In addition, the pigment A is difficult to be uniformly mixed with the superfine fiber-constituting polymer to likely deteriorate the mechanical properties such as tear strength and tensile strength and the color fastness to rubbing of the resultant suede artificial leather. If less than 0.01 μm, the color development of the resultant suede artificial leather tends to be deteriorated. The average particle size is preferably 0.02 to 0.2 μm. In addition, the average particle size is preferably 1/10 or less, more preferably 1/20 or less of the diameter of the superfine fiber in view of the mechanical properties such as tear strength and tensile strength and the color fastness to rubbing of the resultant suede artificial leather. Further, it is preferred for the pigment A to contain little amount of particles having a particle size exceeding 0.5 μm and exceeding 1 μm in view of the mechanical properties such as tear strength and tensile strength and the color fastness to rubbing of the resultant suede artificial leather. Specifically, the amount of particles of over 1-μm particle size is preferably 10% or less, more preferably 5% or less in terms of area basis based on the total pigments. The amount of particles of over 0.5-μm particle size is preferably 20% or less, more preferably 10% or less of the total amount of the pigment A in terms of area basis. The state and the average particle size of dispersed pigment A can be confirmed, if desired after an epoxy resin embedding treatment, a dyeing treatment or an electro-dyeing treatment, by cross-sectionally slicing the superfine fiber into a thin film by a microtome or a super microtome, and observing the thin film under a transmission electron microscope, and if desired, by image-analyzing the thin film using a commercially available image analyzing software.

As the pigment A for coloring the superfine fiber, it is critical in the present invention to use the organic pigment and/or carbon black because of their excellency in the color brilliantness and color development, and their little adverse affect on the fiber properties due to a good spinnability. The inorganic pigment causes a large adverse affect on the spinnability and the fiber properties to deteriorate the mechanical properties and the color fastness to rubbing of the resultant suede artificial leather, and additionally, is difficult to provide a wide variety of colors because of lack of brilliantness and color development. By using the pigment A having an average particle size of 0.01 to 0.3 μm, the deterioration of the mechanical properties and the color fastness to rubbing due to the addition of pigment can be minimized and the color development of the superfine fiber can be enhanced by increasing the amount of pigment to be added.

The content of the pigment A in the superfine fiber constituting the three-dimensional entangled body is suitably selected from 0 to 8% by mass according to the intended color of the suede artificial leather, the intended fineness of fiber, etc. The content is preferably 0 to 0.5% by mass if white color is intended, and preferably 0.1 to 8% by mass if the suede artificial leather is to be colored with a light to more deeper color. The content is preferably 0 to 3% by mass, more preferably 0.1 to 2% by mass for a light color; preferably 0.5 to 8% by mass, more preferably 1 to 5% by mass for a deep color; and preferably 0.2 to 5% by mass, more preferably 0.5 to 4% by mass for an intermediate color between the light color and the deep color. Since the color development is deteriorated with decreasing fineness of the fiber, the addition amount of the pigment should be increased. By using the pigment A having an average particle size specified above, the deterioration of the mechanical properties and color fastness to rubbing due to the increase of the addition amount can be minimized. The light color, deep color and intermediate color referred to herein means a color having a color density expressed by K/S value of 10 or 15 or less for the light color, 15 or 20 or more for the deep color, and 10 or about 20 for the intermediate color. The K/S value is a measure of color density which is calculated by the following formula using a reflectance (R) obtained by Kubelka-Munk function:

$$K/S=(1-R)^2/2R$$

wherein R is a reflectance at a maximum absorption wave length.

If the content of pigment A exceeds 8% by mass, the proportion of pigment A not embedded by the superfine fiber-constituting polymer is increased to likely deteriorate the mechanical properties such as tear strength and tensile strength and the color fastness to rubbing of the resultant suede artificial leather, and also make the spinnability poor.

The content of pigment A in the superfine fiber can be determined by a method of only separating the pigment A by a treatment which removes only the superfine fiber-constituting polymer by dissolution or decomposition while substantially not dissolving or decomposing the pigment A; a method of separating the pigment A from the superfine fiber component by subjecting a mixture of the superfine fiber component and the pigment A obtained by dissolving or decomposing the superfine fiber to column chromatography, liquid chromatography, gel chromatography, etc.; or a method of observing the superfine fiber under an electron microscope. When the superfine fiber partly contains a dye, after removing the dye by repeatedly treating the superfine fiber with hot water to extract the dye or without removing the dye, the pigment A can be separated from the superfine fiber component and the dye by column chromatography, liquid chromatography, gel chromatography, etc. to determine each content. Before analyzing the pigment content of the superfine fiber, if desired, the superfine fiber can be separated from the elastomeric polymer by removing either of the elastomeric polymer and the superfine fiber by dissolution or decomposition to obtain only the superfine fiber. If the superfine fiber is made of polyester, the polyester component and the pigment A can be separated by a method where a decomposition solution obtained by decomposing the polyester component with an aqueous alkali solution is subjected to column chromatography with water; or a method where a decomposition solution from alkali treatment is dried, diluted with an organic solvent and then subjected to column chromatography with an organic solvent. Alternatively, the pigment content can be determined by a calculation method where the ratio by mass of the pigment A is calculated from the specific gravities of the superfine fiber and the pigment A obtained by the methods mentioned above and the corresponding area obtained by analyzing the image of the superfine fiber under an electron microscope using a commercially available image analyzing software.

If only the elastomeric polymer is colored with a pigment while not incorporating the pigment into the superfine fiber, although not so significant when pigmented to white or light color, whitish surface fibers stand out clearly to deteriorate the exterior appearance when pigmented to other colors. In addition, the surface superfine fiber containing no pigment covers over the pigmented elastomeric polymer to prevent and deteriorate the color development of the elastomeric polymer. To avoid this drawback by dyeing, a large amount of dye is required to limit the improvement of the color fastness to light.

In contrast, if only the superfine fiber is colored with pigment while not incorporating the pigment into the elastomeric polymer, the elastomeric polymer is photo-deteriorated because of the absence of pigment to limit the improvement of the color fastness to light, and additionally, whitish elastomeric polymer stands out clearly to deteriorate the exterior appearance. It is industrially difficult to attain various colors only by pigmenting the fiber because the apparatuses for spinning and production should be switched to increase the production loss. In addition, since the color development of superfine fiber having a fineness as small as 0.2 dtex or less is quite poor, the coloring of only the superfine fiber with pigment provides dull colors, resulting in the substantial lack of the color development and the narrow range of developed colors. If a large amount of pigment is incorporated to enhance the color development, the spinning becomes difficult because of the clogging of filter and the increase in spinning pressure, and the properties and the color fastness to rubbing of the resultant fibers are largely deteriorated.

Therefore, to produce a suede artificial leather having excellent color development and color fastness to light in a wide range of colors by using the pigment, industrially most preferred is a method of coloring the superfine fiber to multiple color of two to five colors of red, blue, yellow, black, etc. with the pigment A (organic pigment and/or carbon black), pigmenting the elastomeric polymer to a desired color, and then mixing the colors of the pigmented superfine fiber and the pigmented elastomeric polymer. The superfine fiber and the elastomeric polymer may be pigmented to analogous colors or different colors. In particular, a suede artificial leather with a quite uniform and high quality can be obtained when the superfine fiber and the elastomeric polymer are pigmented to analogous colors.

The pigment A (organic pigment and/or carbon black) to be incorporated into the superfine fiber is not particularly limited as far as it has an average particle size of 0.01 to 0.3 μm and can be mixed with the superfine fiber-constituting polymer to form an integrated whole and embedded mainly by the superfine fiber-constituting polymer. Examples of the organic pigment include condensed polycyclic organic pigments such as phthalocyanine compounds, anthraquinone compounds, quinacridone compounds, dioxazine compounds, isoindolinone compounds, isoindoline compounds, indigo compounds, quinophthalone compounds, diketopyrrolopyrrole compounds, perylene compounds, and perinone compounds; and insoluble azo pigments such as benzimidazolone compounds, disazo condensation compounds and azomethineazo compounds. Example of carbon black include channel black, furnace black and thermal black, but the type of carbon black usable in the present invention is not limited at all. At least one of the organic pigment and carbon black is incorporated into the fiber as the pigment A.

Inorganic pigments may be combinedly used in a small amount as far as the effect of the present invention is adversely affected, if the inorganic pigments have an average particle size of 0.01 to 0.3 μm, and can be mixed with the superfine fiber-constituting polymer to form an integrated whole and embedded mainly by the superfine fiber-constituting polymer. Examples thereof include titanium oxide, red iron oxide, chromium red, molybdenum red, litharge, ultramarine, iron oxide and silica. If the use in applications requiring a high color fastness to light is intended, for example as a car seat, it is preferred to avoid the use of pigment highly susceptible to photo-deterioration.

In view of the brilliantness, color development, color fastness to light, color fastness to rubbing, mechanical properties, spinnability, etc., particularly preferred is the use of only at least one pigment selected from the group consisting of the condensed polycyclic organic pigments such as phthalocyanine compounds, anthraquinone compounds, quinacridone compounds, dioxazine compounds, isoindolinone compounds, isoindoline compounds, indigo compounds, quinophthalone compounds, diketopyrrolopyrrole compounds, perylene compounds, and perinone compounds; the insoluble azo pigments such as benzimidazolone compounds, disazo condensation compounds and azomethineazo compounds; and carbon blacks.

The method for incorporating the pigment A is not particularly limited, and a known method may be employed. Preferably employed is a master batch method in which the superfine fiber-constituting polymer and the pigment A are kneaded in a compounder such as extruders and then formed into pellets, because the dispersibility of pigment A in the superfine fiber-constituting polymer is improved and the production costs is reduced. It is preferred to confirm in advance whether the pigment A is uniformly dispersed throughout the master batch, and confirm whether the pigment is uniformly dispersed throughout the superfine fiber-constituting polymer by a preliminary spinning test.

Although the organic pigment is superior to the inorganic pigment in its little adverse affect on the color development, brilliantness, color fastness to rubbing, mechanical properties, etc., the organic pigment is partly dissolved in an organic solvent. The inventors have found that it is industrially effective to fibrillate the superfine fiber-forming fiber in an aqueous solution without using an organic solvent when the fiber is colored with the organic pigment. The aqueous solution referred to herein is water or an aqueous solution substantially free from organic solvent. In the process of fibrillating the superfine fiber-forming fiber by extraction with an organic solvent which has been generally employed in the conventional methods for producing the artificial leather, the dissolution and release of the organic pigment occur in the process of extraction with an organic solvent to likely reduce the color development and cause the color variation, thereby failing to achieve an industrially stable productivity. In contrast, the inorganic pigment is sparingly soluble in an organic solvent, allowing to use the process of fibrillating the superfine fiber-forming fiber by extraction with an organic solvent. However, the effect of the present invention cannot be obtained by coloring the superfine fiber mainly with the inorganic pigment (exclusive of carbon black), because it causes, as mentioned above, deterioration in the brilliantness, color development, color fastness to rubbing, spinnability, fiber properties, etc.

In the present invention, the average fineness of the superfine fiber is 0.2 dtex or less. If exceeding 0.2 dtex, the difference in colors and color developments between the pigmented fiber and the pigmented elastomeric polymer becomes remarkable thereby to deteriorate the exterior appearance of the resultant suede artificial leather. In addition, the suede feeling and the surface touch are deteriorated because of large fineness. The fineness of the superfine fiber is preferably 0.0001 to 0.2 dtex, more preferably 0.001 to 0.1 dtex because the colors and color developments of the pigmented fiber and the pigmented elastomeric polymer are well balanced and a high-quality suede artificial leather with a good color, color development, suede feeling and surface touch can be obtained. The average fineness of the superfine fiber constituting the suede artificial leather can be determined by observing the cross section or surface of the suede artificial leather under a scanning electron microscope, etc.

Although the superfine fiber is inherently poor in the color development, the color development of the resultant suede artificial leather can be enhanced by coloring both the superfine fiber and the elastomeric polymer with pigments. In the present invention, since a wide range of colors can be attained by the combination of the pigment A in the fiber and the pigment B in the elastomeric polymer, the color development of the suede artificial leather can be further enhanced by combinedly using a process of coloring the surface of the suede artificial leather with only pigment or with a dye in an amount as small as not adversely affect the effect of the present invention. Therefore, the present invention is particularly effective for improving the color development, colors, color fastness to light and color fastness to rubbing of a highest-quality suede artificial leather comprising ultra superfine fibers of 0.05 dtex or less.

In the suede artificial leather of the present invention, the average raised nap length of the superfine fiber on the surface thereof is 10 to 200 μm. If exceeding 200 μm, the underlying elastomeric polymer is completely covered with the fiber to prevent the color development of the pigment B in the elastomeric polymer, this making the color of the fiber excessively dominant to result in the failure in obtaining a wide variety of colors. If less than 10 μm, the uneven color becomes marked in the fiber and the elastomeric polymer, and the suede feeling and the surface touch tend to be deteriorated. The suede feeling, surface touch and colors can be regulated by suitably selecting the average raised nap length of the superfine fiber. For example, 50 to 200 μm is preferred for suede finish, and 10 to 100 μm is preferred for short nubuck finish. If the average raised nap length is increased, the suede artificial leather assumes the color analogous to the color of the fiber. If the average raised nap length is shortened, the color of the elastomeric polymer tend to be heightened. The average raised nap length may be determined by observing the cross section and surface of the suede artificial leather under a scanning electron microscope.

In the present invention, the polymer for constituting the superfine fiber may be suitably selected from polymers which can form the superfine fiber without extracted in the extraction process, etc., depending on the applications and desired properties Examples thereof include aromatic polyesters and their copolymers such as polyethylene terephthalate, isophthalic acid-modified polyethylene terephthalate, sulfoisophthalic acid-modified polyethylene terephthalate, polybutylene terephthalate and polyhexamethylene terephthalate; aliphatic polyesters and their copolymers such as polylactic acid, polyethylene succinate, polybutylene succinate and polybutylene succinate adipate and polyhydroxy butyrate-polyhydroxy valerate copolymer; polyamides and their copolymers obtained by ring-opening polymerization of lactam, dehydrating polycondensation of aminocarboxylic acid or dehydrating polycondensation of aliphatic diamine and aliphatic dicarboxylic acid, such as nylon 6, nylon 66, nylon 10, nylon 11, nylon 12 and nylon 6-12; polyolefins and their copolymers such as polypropylene, polyethylene, polybutene, polymethylpentene and chlorinated polyolefins; modified polyvinyl alcohols containing 25 to 70 mol % of ethylene unit; and elastomers such as polyurethane elastomers, nylon elastomers and polyester elastomers. These polymers may be used alone or in combination of two or more. A separable and splittable composite of the above polymers may be also usable.

Of the above polymers, polyester such as polyethylene terephthalate, isophthalic acid-modified polyethylene terephthalate and polylactic acid; polyamide such as nylon 6, nylon 12 and nylon 6-12; and polyolefin such as polypropylene are preferred because these are excellent in the processability such as spinnability and provide a suede artificial leather having good mechanical properties. If the use in applications requiring a high color fastness to light is intended, polyesters are most preferred.

The superfine fiber-constituting polymer may be blended with additives, if desired, in an amount not adversely affecting the objects and effects of the present invention. Examples of the additives include catalysts, discoloration inhibitors, heat stabilizers, flame retardants, lubricants, antifouling agents, fluorescent brighteners, delusterants, colorants, lustering agents, antistatic agents, aromatizing agents, deodorants, antibacterial agents, miticides and inorganic fine particles.

The polymer to be removed from the superfine fiber-forming fiber by extraction in the fibrillating process may be selected from known polymers which can form sea-island composite fiber or mix-spun composite fiber and can be removed by extraction with an aqueous solution or an organic solvent. Preferred are water-soluble thermoplastic polyvinyl alcohol copolymers (hereinafter occasionally referred to as "PVA") such as polyvinyl alcohol copolymers which are extractable with an aqueous solution, because (1) since PVA is easily removed by extraction with hot water, the release of the pigment during the extraction process is prevented to allow the use of a wide range of pigments including the organic pigment, (2) the superfine fiber-forming fiber is shrunk during the removal of the extractable PVA component by extraction with an aqueous solution to cause the structural crimps of superfine fibers being formed, making the nonwoven fabric bulky and dense thereby to produce a suede artificial leather easily developed to brilliant colors and having flexible, natural leather-like excellent feeling, (3) since substantially no decomposition of the superfine fiber and the elastomeric polymer occurs in the removing process by extraction, the properties of the thermoplastic resin for forming the superfine fiber and the elastomeric polymer are hardly deteriorated, and (4) PVA is environmentally safe.

Since the spinnability of PVA becomes poor at relatively high spinning temperatures, it is preferred to suitably select the melting point of the polymer for constituting the superfine fiber. Therefore, the superfine fiber-constituting polymer is preferably selected from thermoplastic polymers having a melting point of M+60° C. or less, wherein M is the melting point of the polymer to be removed by extraction in the fibrillating process. The melting point (Tm) of PVA is preferably 160 to 230° C. in view of spinnability.

Polyvinyl alcohol referred to in "water-soluble thermoplastic polyvinyl alcohol copolymers" includes polyvinyl alcohol homopolymers and also includes modified polyvinyl alcohols having a functional group introduced, for example, by copolymerization, terminal modification or post reaction.

Polymers removable by extraction with an organic solvent may include low density polyethylenes and polystyrenes. However, considerable care must be taken so as to avoid the elution of pigment if such polymers are used. Other examples of the polymers removable by an aqueous solution include copolyesters which can be easily decomposed by alkali. However, great care must be taken so as to avoid the elution of pigment and the adverse affect on the properties of the fiber and the elastomeric polymer. If PVA is not used as the polymer to be removed by extraction, the resultant suede artificial leather tends to become less bulky and dense thereby likely to deteriorate the color development, flexibility, dense feeling and suede feeling.

PVA may be a homopolymer or a modified PVA having a copolymerized unit, with the modified PVA being preferred in view of the melt spinnability, water solubility, fiber properties, shrinking properties in the extraction process, etc. More preferred is the modified PVA having a copolymerized unit derived from α-olefins having four or less carbon atoms such as ethylene, propylene, 1-butene and isobutene; and vinyl ethers such as methyl vinyl ether, ethyl vinyl ether, n-propyl vinyl ether, isopropyl vinyl ether and n-butyl vinyl ether. The content of the copolymerized unit derived from the α-olefins and/or the vinyl ethers in the modified PVA is preferably 1 to 20 mol %. Since the fiber properties are enhanced when the copolymerized unit is ethylene unit, a modified PVA having 4 to 15 mol % of ethylene unit is particularly preferred.

The viscosity-average degree of polymerization (hereinafter occasionally referred to merely "degree of polymerization") of PVA preferably used in the present invention is preferably 200 to 500. If less than 200, a sufficient stringiness cannot be obtained in the spinning process, failing to form fiber in some cases. If exceeding 500, the polymer may be not discharged from the spinning nozzle because of excessively high viscosity. By using a low polymerization degree PVA having a degree of polymerization of 500 or less, the dissolution speed into an aqueous solution can be favorably increased in the removing process by extraction. The degree of polymerization (P) of PVA may be measured according to JIS K6726.

The saponification degree of PVA is preferably 90 to 99.99 mol %. If less than 90 mol %, PVA is difficult to be sufficiently melt-spun because the heat stability is poor to cause thermal decomposition or gelation of PVA. In addition, the water solubility of PVA is reduced to make the formation of the superfine fiber difficult, although depending on the type of the copolymerized monomer mentioned above. PVA having a saponification degree of exceeding 99.99 mol % cannot be stably produced, and may be difficult to be formed into stable fiber.

The melting point (hereinafter occasionally referred to as "Tm") of PVA is preferably 160 to 230° C. If less than 160° C., the crystallizability of PVA becomes poor to reduce the tenacity of fiber, and simultaneously, the heat stability of PVA becomes poor to make the fiber formation impossible in some cases. If exceeding 230° C., PVA fiber cannot be stably produced in some cases, because a high melt-spinning temperature is required to allow the spinning temperature to come close to the decomposition temperature of PVA. The melting point of PVA is the peak top temperature of the endothermic peak attributable to the melting of PVA when measured using a differential scanning calorimeter (hereinafter occasionally referred to as "DSC") in nitrogen by heating PVA to 250° C. at a temperature rise rate of 10° C./min, cooling to room temperature, and then heating to 250° C. at a temperature rise rate of 10° C./min.

The content of alkali metal ion in PVA is preferably 0.0003 to 1 part by mass based on 100 part by mass of PVA in terms of sodium ion. If less than 0.0003 part by mass, the water solubility of PVA is insufficient to leave non-dissolved PVA. If exceeding 1 part by mass, the decomposition and gelation in the melt-spinning process become remarkable to make the fiber formation difficult. The alkali metal ion may include potassium ion and sodium ion. The content of the alkali metal ion may be measured by atomic-absorption spectroscopy.

The content of the central hydroxyl group of the three successive vinyl alcohol unit chain by triad expression is preferably 70 to 99.9 mol %. If less than 70 mol %, the crystallizability of PVA becomes poor to reduce the tenacity of fiber, and simultaneously, the fibers are agglutinated to each other in the melt-spinning process to make it difficult to unwind the taken-up fibers. In addition, a water-soluble thermoplastic PVA fiber intended in the present invention cannot be obtained in some cases. If exceeding 99.9 mol %, a high spinning temperature is required because of a high melting point of PVA to make the heat stability of PVA poor, thereby likely to cause the decomposition, gelation and discoloration of PVA. The central hydroxyl group of the three successive vinyl alcohol unit chain by triad expression referred herein means the peak (I) attributable to the triad tacticity of the hydroxyl proton when analyzing a d6-DMSO solution of PVA at 65° C. by a 500 MHz $^1$H-NMR using JEOL GX-500 NMR apparatus. The peak (I) is expressed by the sum of the isotactic triad (4.54 ppm), the heterotactic triad (4.36 ppm) and the syndiotactic triad (4.13 ppm) of hydroxyl groups in PVA. The peak (II) attributable to hydroxyl groups in all the vinyl alcohol units appears in the chemical shift of 4.05 to 4.70 ppm. Thus, the molar ratio of the central hydroxyl group of the three successive vinyl alcohol unit chain by triad expression to the vinyl alcohol units is calculated from: [(I)/(II)]×100(%).

In the present invention, the elastomeric polymer A for constituting the suede artificial leather is pigmented by containing an organic pigment having an average particle size of 0.05 to 0.6 μm and/or carbon black having an average particle size of 0.05 to 0.6 μm, or a pigment particle having an average particle size of 0.05 to 0.6 μm containing an organic pigment (hereinafter these may be collectively referred to as "pigment B"), in an amount of 1 to 20% by mass. The present invention is further based on the following findings.

(1) To achieve excellent brilliantness and color development and to minimize the deterioration of the mechanical properties and the color fastness to rubbing due to the addition of pigment, it is required to use the pigment B in place of the inorganic pigments. Also, the pigment B is required to have an average particle size of 0.05 to 0.6 μm.
(2) The color fastness to light of the elastomeric polymer A can be enhanced by the addition of the pigment B probably because of the light shielding effect and the UV absorption effect of the pigment B.
(3) Since the color development of the fiber having a fineness of 0.2 dtex or less is quite insufficient, a sufficient color development cannot be attained only by developing the superfine fiber. This problem can be solved by incorporating the pigment B into the underlying elastomeric polymer A thereby to enhance the color development of the suede artificial leather.
(4) A wide rage of colors can be obtained by mixing the color of the superfine fiber and the color of the elastomeric polymer A.
(5) To enhance the high quality by making the color of the superfine fiber analogous to the color of the elastomeric polymer A, it is required that the elastomeric polymer A contains the pigment B having an average particle size of 0.05 to 0.6 μm in an amount of 1 to 20% by mass.

The pigment B is preferably mixed with the elastomeric polymer A to form an integrated whole, and embedded mainly in the polymer constituting the elastomeric polymer A. The words "the pigment B is preferably mixed with the elastomeric polymer A to form an integrated whole, and embedded mainly in the polymer constituting the elastomeric polymer A" referred to herein means that the pigment B is substantially uniformly distributed throughout the elastomeric polymer A without separately and unevenly distributed from the elastomeric polymer A. If the content of the pigment B is less than 1% by mass, the resultant suede artificial leather may be lacking in the color fastness to light and color development and the range of obtainable colors may be narrowed. If exceeding 20% by mass, the proportion of pigment B not embedded by the elastomeric polymer A is increased to likely deteriorate the fastness such as the color fastness to rubbing of the resultant suede artificial leather, and also the tensile strength and the surface wear resistance may be deteriorated because the binding ability to superfine fibers of the elastomeric polymer A is lowered. To enhance the color development of the elastomeric polymer A, it is effective to increase the addition amount of the pigment B and, as mentioned above, to regulate the average raised nap length of the surface superfine fiber within a relatively short range of 10 to 200 μm. Also, even in case of light colors and white color are intended, the elastomeric polymer A preferably contains the pigment B in an amount of 1% by mass or more to enhance the high quality by increasing the color depth and also enhance the color fastness to light.

The content of the pigment B in the elastomeric polymer A can be determined by a method of separating the pigment B from the elastomeric polymer A component by subjecting a mixture of the elastomeric polymer A component and the pigment B obtained by dissolving or decomposing the elastomeric polymer A to column chromatography, liquid chromatography, gel chromatography, etc.; or a method of observing the elastomeric polymer A under an electron microscope. When the elastomeric polymer A partly contains a dye, after removing the dye by repeatedly treating the elastomeric polymer A with hot water to extract the dye or without removing the dye, the pigment B can be separated from the elastomeric polymer A component and the dye by column chromatography, liquid chromatography, gel chromatography, etc. to determine each content. Before analyzing the content of the pigment B in the elastomeric polymer A, if desired, the elastomeric polymer A can be separated from the superfine fiber by removing either of the elastomeric polymer A and the superfine fiber by dissolution or decomposition to obtain only the elastomeric polymer A. If the elastomeric polymer A is soluble in the organic solvents such as hot dimethylformamide, hot acetone and hot methyl ethyl ketone which are used in the production of the elastomeric polymer A, the elastomeric polymer A component can be separated from the pigment B for determining the contents by subjecting a solution of the pigment B and the elastomeric polymer A in such an organic solvent to column chromatography with an organic solvent. If the elastomeric polymer A is insoluble in hot organic solvents, the elastomeric polymer A is hydrolyzed by a hot alkali treatment or oxidatively degraded by heat treatment or by the action of oxidation accelerator, and then dissolved into a hot organic solvent. Then, the elastomeric polymer A component can be separated from the pigment B for determining the contents by organic solvent- or water-eluted column chromatography of the resultant solution of the pigment B and the elastomeric polymer A component. Alternatively, the content of the pigment B can be determined by a calculation method where the ratio by mass of the pigment B is calculated from the specific gravities of the elastomeric polymer A and the pigment B in the manner mentioned above and the corresponding area obtained by analyzing the image of the elastomeric polymer A under an electron microscope using a commercially available image analyzing software.

The pigment B for the elastomeric polymer A is required to be, not the inorganic pigment commonly used, the organic pigment and/or carbon black, or the pigment particle containing the organic pigment, in view of enhancing the brilliantness and color development and minimizing the deterioration of the mechanical properties and color fastness to rubbing associated by the addition of pigment. In addition, it is industrially effective to use a water-dispersed elastomeric polymer A in coloring the elastomeric polymer A with the organic pigment or the pigment particle containing the organic pigment, because the organic pigments are partly dissolved into organic solvents. The water-dispersed elastomeric polymer referred to herein means the elastomeric polymer A dispersed in water or an aqueous solution substantially free from organic solvents.

In the conventionally common method for impregnating and wet-coagulating the elastomeric polymer dissolved in an organic solvent, the organic pigment is partly dissolved and released in the coagulation process and the washing process with an organic solvent. This causes the deterioration of the color development of the suede artificial leather, color variation and increase of the switching loss, thereby likely to make the industrial use of the organic pigment difficult. The inorganic pigment may be incorporated into the elastomeric polymer dissolved in an organic solvent, because it is substantially or completely insoluble into organic solvents. However, the effect of the present invention cannot be obtained by coloring the elastomeric polymer with only the inorganic pigment because there are tendencies to deteriorate the brilliantness and color development thereby to significantly narrow the range of obtainable colors, to cause pigment soiling because of unsuccessful impregnation process due to insufficient compatibility with the elastomeric polymer, and to adversely affect the tensile properties, surface abrasion resistance, color fastness to rubbing, etc.

The average particle size of pigment B to be incorporated into the elastomeric polymer A is 0.05 to 0.6 μm. The average particle size referred to herein is an average particle size of the pigment B present the elastomeric polymer A, and not a primary particle size. The pigment scarcely presents as primary particles, and generally presents as agglomerate consisting of a large number of primary particles, such as structure, primary agglomerate, secondary agglomerate and secondary particle. The state of agglomerate depends on the types of the pigment and the elastomeric polymer, etc. and the particle size of the pigment in the form of agglomerate is considered to govern the various properties. The average particle size referred to herein is the average particle size of the pigment B present in the polymer constituting the elastomeric polymer A in the form of agglomerates such as structure, primary agglomerate, secondary agglomerate and secondary particle.

If the average particle size of the pigment B is less than 0.05 μm, the color fastness to light of the suede artificial leather tends to be deteriorated, probably because of the deterioration of the light shielding effect and the color fastness to light of the pigment. In addition, the pigment B comes to easily agglomerate in an elastomeric polymer solution thereby to fail to be uniformly distributed throughout the elastomeric polymer solution, this causing uneven color development and uneven color of the suede artificial leather. If the content of the pigment B exceeds 0.6 μm, the pigment becomes difficult to be embedded in the elastomeric polymer A to likely deteriorate the fastness such as the color fastness to rubbing of the suede artificial leather. Also, there is a tendency to cause uneven color development and uneven color of the suede artificial leather because the pigment is easily sedimented during the blend process with the elastomeric polymer thereby to make the impregnation process for providing the elastomeric polymer A containing the pigment B unsuccessful. The average particle size of the pigment B is preferably 0.1 to 0.5 μm. The average particle size and the dispersed state of the pigment B in the elastomeric polymer A of the suede artificial leather can be confirmed by observing the cross section and surface of the suede artificial leather under a scanning or transmission electron microscope.

The pigment B to be incorporated into the elastomeric polymer A is not particularly limited as far as it is the organic pigment and/or carbon black, or the pigment particle containing the organic pigment, each having an average particle size of 0.05 to 0.6 μm and can be mixed with a polymer constituting the elastomeric polymer A to form an integrated whole and embedded mainly by the polymer. Examples of the organic pigment include condensed polycyclic organic pigments such as phthalocyanine compounds, anthraquinone compounds, quinacridone compounds, dioxazine compounds, isoindolinone compounds, isoindoline compounds, indigo compounds, quinophthalone compounds, diketopyrrolopyrrole compounds, perylene compounds, and perinone compounds; and insoluble azo pigments such as benzimidazolone compounds, disazo condensation compounds and azomethineazo compounds. Example of carbon black include channel black, furnace black and thermal black, but the type of carbon black usable in the present invention is not limited at all. At least one of the organic pigment and carbon black is incorporated into the elastomeric polymer.

The pigment particle containing the organic pigment comprises a mixture of the organic pigment with carbon black or at least one inorganic pigment as described below. The content of the inorganic pigment in the pigment particle is preferably 50% by mass or less, and more preferably 20 to 50% by mass. If exceeding 50% by mass, the brilliantness, color development, mechanical properties and color fastness to rubbing tend to be deteriorated.

Inorganic pigments may be combinedly used in an amount as far as the effect of the present invention is adversely affected, if the inorganic pigments have an average particle size of 0.05 to 0.6 μm and can be mixed with the polymer constituting the elastomeric polymer A to form an integrated whole and embedded mainly by the polymer. Examples thereof include titanium oxide, red iron oxide, chromium red, molybdenum red, litharge, ultramarine and iron oxide.

Particularly preferred as the pigment B for incorporating into the elastomeric polymer A is a combination of the condensed polycyclic organic pigment and the insoluble azo pigment, an only use of the condensed polycyclic organic pigment and/or the insoluble azo pigment, and a combination of the condensed polycyclic organic pigment and/or the insoluble azo pigment as the main pigment with carbon black, titanium oxide, etc. which are selected depending on intended colors, etc., because the resultant suede artificial leather is excellent in the brilliantness, color development, width of the range of obtainable colors, color fastness to light, color fastness to rubbing and surface abrasion resistance. In the present invention, "the pigment B containing the condensed polycyclic organic pigment and/or the insoluble azo pigment" means a pigment consisting of the condensed polycyclic organic pigment and/or the insoluble azo pigment, or a pigment comprising the condensed polycyclic organic pigment and/or the insoluble azo pigment as the major component and optionally comprising carbon black, titanium oxide, etc. according to the intended colors. If the use in applications requiring a high color fastness to light is intended, for example as a car seat, it is preferred to avoid the use of pigment highly susceptible to photo-deterioration.

In the present invention, the use of a water-dispersed elastomeric polymer prepared by diluting the elastomeric polymer A with a liquid, which is non-solvent for the elastomeric polymer A, such as water and the use of a water-dispersed pigment prepared by diluting the pigment B with a liquid, which is non-solvent for the pigment B, such as water are preferred, because the pigment B is well dispersed in the elastomeric polymer A. It is preferred for both the water-dispersed elastomeric polymer and the water-dispersed pigment that the dispersion is nonionic, anionic or combination thereof, because the dispersibility of pigment B into the elastomeric polymer A is enhanced and the mixed dispersion containing the elastomeric polymer A and the pigment B is well stabilized, thereby making it easy for the pigment B to be uniformly dispersed in the elastomeric polymer A and to be embedded by the elastomeric polymer A. It is preferred to confirm before use the dispersibility of the pigment B in the elastomeric polymer A and the stability of the mixed dispersion containing the elastomeric polymer A and the pigment B by examine whether the pigment B is uniformly dispersed in the elastomeric polymer A and whether the pigment B is embedded mainly by the elastomeric polymer A.

The elastomeric polymer A used in the present invention is preferably a water-dispersed elastomeric polymer having an average particle size of 0.1 to 0.7 μm which is capable of forming a transparent film. If the film of the elastomeric polymer A is opaque, the color development of the pigment B is prevented to likely deteriorate the color development and brilliantness of the suede artificial leather. If the average particle size exceeds 0.7 μm, the color development of the pigment B is prevented to likely deteriorate the color development and brilliantness of the suede artificial leather, because the film becomes opaque. If the average particle size is less than 0.1 μm, the suede artificial leather tends to be hard in its feeling. The average particle size is particularly preferred to be 0.15 to 0.6 μm. The average particle size of the water-dispersed elastomeric polymer may be determined by known methods such as a dynamic scattering method. The average particle size of the elastomeric polymer A derived from the water-dispersed elastomeric polymer in the suede artificial leather may be determined by observing the suede artificial leather under a transmission electron scope after a coloring treatment or a treatment with a cross-linkable resin, if desired.

To meet the above requirements, the average particle size of the water-dispersed elastomeric polymer can be suitably regulated by a known method. Particularly preferred elastomeric polymer A is a polyurethane comprising an aliphatic diisocyanate or alicyclic diisocyanate as the diisocyanate component (hereinafter occasionally referred to as "non-yellowing polyurethane"), because an average particle size of 0.7 μm or less can be easily attained in industrial scale and its film tends to be highly transparent as compared with a polyurethane derived from an aromatic diisocyanate even when the average particle sizes are identical.

In the applications such as car seats requiring a high color fastness to light, it is preferred to use an elastomeric polymer A having a color fastness to light of 3rd rating or higher, more preferably 4th rating or higher when measured on an elastomeric polymer film by the evaluation method of color fastness to xenon arc lamp light (black panel temperature=83° C.; accumulated irradiated illuminance=20 MJ) in accordance with JIS L0804. For example, a polyurethane derived from a diisocyanate component containing less than 10% by mass of aromatic diusocyanate meet the above requirements. The aromatic diisocyanate referred to herein means an aromatic ring-containing diisocyanate which is used as the diisocyanate component of polyurethane, etc. Examples thereof include known compounds such as 2,4-tolylene diisocyanate, 2,6-tolylene diisocyanate, 4,4'-diphenylmethane diisocyanate and xylylene diisocyanate. If the content of the aromatic diisocyanate in the diisocyanate component is 10% by mass or more, the light discoloration due to the yellowing of the elastomeric polymer and the color photo-fading of the pigment attributable to the photo degradation of the elastomeric polymer are likely to occur in the suede artificial leather, thereby limiting the improvement of the color fastness to light. Alternatively, the use of special pigments extremely excellent in the color fastness to light or special pigments of little thermal storage by the absorption of infrared ray is required to increase production costs and, in addition, to make it difficult to obtain a wide variety of colors because the usable pigments are limited. Particularly in the applications such as car seats requiring a high color fastness to light, the diisocyanate component for constituting polyurethanes is preferably an aliphatic or alicyclic organic diisocyanate containing no aromatic ring such as hexamethylene diisocyanate, isophorone diisocyanate, norbornene diisocyanate and 4,4'-dicyclohexylmethane diisocyanate. If applications not requiring a high color fastness to light are intended, the aromatic organic diisocyanate may be used as the diisocyanate component in an amount not adversely affecting the effect of the present invention.

The hot water swelling rate of the elastomeric polymer A for constituting the suede artificial leather is preferably 20% or less when measured immediately after immersion into a hot water of 130° C. If exceeding 20%, the elastomeric polymer A deforms by swelling in the fibrillating treatment or flexibilizing treatment in an aqueous solution or in the optional dyeing treatment not adversely affecting the effect of the present invention. The deformation of the elastomeric polymer A by swelling causes the release of the pigment B or allows the pigment B embedded in the elastomeric polymer A to be easily exposed, thereby likely to deteriorate the color development, brilliantness and color fastness to rubbing of the resultant suede artificial leather. In addition, it may become difficult to regulate the average raised nap length of the surface fibers within a relatively short range of 10 to 200 μm. Since the water-dispersed elastomeric polymer tends to show a hot water swelling rate at 130° C. higher than that of the organic solvent-type elastomeric polymer which has been used in the conventional production of artificial leathers, it is preferred to lower the hot water swelling rate at 130° C. by crosslinking the elastomeric polymer A with a three-functionalized compound.

The hot water swelling rate of the elastomeric polymer A immediately after the immersion in a hot water of 130° C. may be determined, as will be described below, by measuring the mass (W0) of an elastomeric polymer cast film after treatment at 120 to 150° C., measuring the mass (W) of the cast film after immersion in a hot water of 130° C. for one hour, and then calculating the hot water swelling rate from the following formula:

$$\text{Hot water swelling rate at } 130^\circ\text{ C. } (wt\%)=[(W-W0)/W0]\times 100.$$

The polymeric polyol for constituting polyurethanes may be selected from known polymeric polyols according to the intended applications and the desired properties. Examples thereof include polyether polyols such as polyethylene glycol, polypropylene glycol, polytetramethylene glycol and poly(methyltetramethylene glycol); polyester polyols such as polybutylene adipate diol, polybutylene sebacate diol, polyhexamethylene adipate diol, poly(3-methyl-1,5-pentylene adipate) diol, poly(3-methyl-1,5-pentylene sebacate) diol and polycaprolactone diol; polycarbonate polyols such as polyhexamentylene carbonate diol and poly(3-methyl-1,5-pentylene carbonate) diol; and polyester carbonate polyols. These may be used singly or in combination of two or more. It is preferred to combinedly use two or more polymeric polyols selected from the polyether polyols, polyester polyols and polycarbonate polyols, in view of obtaining a suede artificial leather having an excellent color fastness to light and an excellent resistance to NOx yellowing, perspiration and hydrolysis.

The chain extending component for the polyurethane may be selected from known chain extenders used in the production of urethane resins according to the intended applications-and the desired properties. Examples thereof include diamines such as hydrazine, ethylenediamine, propylenediamine, hexamethylenediamine, nonamethylenediamine, xylylenediamine, isophoronediamine, piperazine and its derivatives, adipoyldihydrazide and isophthaloyldihydrazide; triamines such as diethylenetriamine; tetramines such as triethylenetetramine; diols such as ethylene glycol, propylene glycol, 1,4-butanediol, 1,6-hexanediol, 1,4-bis(β-hydroxyethoxy)benzene and 1,4-cyclohexanediol; triols such as trimethylolpropane; pentols such as pentaerythritol; and aminoalcohols such as aminoethyl alcohol and aminopropyl alcohol. These chain extenders may be used alone or in combination of two or more. The chain extending reaction may be carried out in the presence of, in addition to the chain extender, monoamines such as ethylamine, propylamine and butylamine; carboxyl group-containing monoamines such as 4-aminobutyric acid and 6-aminohexanoic acid; and mono alcohols such as methanol, ethanol, propanol and butanol.

To control the particle size and properties of the water-dispersed elastomeric polymer, carboxyl groups may be introduced into the backbone chain of the urethane resin, for example, by using a carboxyl group-containing diol such as 2,2-bis(hydroxymethyl)propionic acid, 2,2-bis(hydroxymethyl)butanoic acid 2,2-bis(hydroxymethyl)valeric acid as the additional starting material for the urethane resins.

It is also preferred to use as the elastomeric polymer A an acryl-urethane composite elastomeric polymer composed of a polyurethane combined with an acryl component excellent in the color fastness to light in view of obtaining a suede artificial leather excellent in fastness such as color fastness to light. The acryl-urethane composite elastomeric polymer preferably has a sea-island structure composed of a polyurethane component as the continuous sea component and an acryl component as the discontinuous island component in a ratio of 10:90 to 90:10 by mass. When the elastomeric polymer composed of the polyurethane component and the acryl component is used, it is preferred for the pigment B to be mixed with the polyurethane component to form an integrated whole, because the release of the pigment B is prevented to ensure the fastness such as color fastness to rubbing. If the use in applications such as car seats which require a high color fastness to light is intended, it is also preferred that the content of the aromatic diisocyanate in the elastomeric polymer A of the acryl-polyurethane composite type is less than 10% by mass.

The acryl-urethane composite elastomeric polymer may be produced by known methods, for example, by an emulsion polymerization of an ethylenically unsaturated monomer mainly comprising a (meth)acrylic acid derivative in the presence of an aqueous dispersion of an urethane resin or by a known emulsion polymerization of an ethylenically unsaturated monomer. Examples of the ethylenically unsaturated monomer include alkyl (meth)acrylates such as methyl (meth)acrylate, ethyl (meth)acrylate, butyl (meth)acrylate and 2-ethylhexyl (meth)acrylate. The polymer may be crosslinked by copolymerizing a small amount of a polyfunctional ethylenically unsaturated monomer such as 1,6-hexanediol di(meth)acrylate, 1,9-nonanediol di(meth)acrylate, neopentyl glycol di(meth)acrylate, divinylbenzene and ally (meth)acrylate.

The elastomeric polymer A may contain a crosslinking agent for its main resin, such as compounds having two or more functional groups which are capable of reacting with the functional group of the main resin. The combination of the functional groups of the main resin and the crosslinking agent may be carboxyl group and oxazoline group; carboxyl group and carbodiimide group; carboxyl group and epoxy group; carboxyl group and cyclocarbonate group; carboxyl group and aziridine group; and carboxyl group and hydrazide group. The combination of the main resin having carboxyl groups and the crosslinking agent having oxazoline groups or carbodiimide groups is preferred because of high solution stability and easiness of production.

The elastomeric polymer may further contain penetrants, thickening agents, antioxidants, ultraviolet absorbers, film-forming aids, heat-sensitive gelling agents, softening agents, lubricants, stain resistance agents, fluorescent agents, antibacterial agents, flame retardants, water-soluble polymers such as polyvinyl alcohol and carboxymethylcellulose, dye, etc., as far as the effect of the present invention is not adversely affected.

In the suede artificial leather of the present invention, the mass ratio of the elastomeric polymer A inclusive of the pigment B to the three-dimensional entangled body inclusive of the pigment A is 15:85 to 60:40. If the content of the elastomeric polymer A is less than 15% by mass, the color development thereof is relatively insufficient as compared with that of the superfine fiber or the color development of the elastomeric polymer A is prevented, because the binding ability to superfine fiber becomes insufficient and the average raised nap length of the surface superfine fiber becomes difficult to be regulated within a relatively short range of 10 to 200 μm, thereby failing to attain a wide range of colors. In addition, the color fastness to rubbing and abrasion resistance tend to be deteriorated. If the content of the elastomeric polymer A is larger than 60% by mass, the uneven color becomes remarkable in the superfine fiber and the elastomeric polymer A or the suede feeling becomes insufficient to reduce the quality. In addition, the mechanical properties such as tensile strength and tear strength tend to be deteriorated. The ratio of the elastomeric polymer A to the three-dimensional entangled body is particularly preferred to be 20:80 to 50:50 by mass. The ratio may be determined by removing only one of the superfine fiber and the elastomeric polymer A by dissolution or decomposition.

In the present invention, it is particularly preferred to color the suede artificial leather to the indented colors by incorporating the pigments into the superfine fiber and elastomeric polymer A without using dyes. The suede artificial leather may be first colored closely to the intended colors and then continuously or discontinuously provided with a layer comprising a elastomeric polymer B containing 0.5 to 25% by mass of a pigment C on its surface around the foots of the raised superfine fibers, thereby matching the colors or controlling the color tones. If desired, the suede artificial leather may be further colored with a small amount of dye, as far as the effect of the present invention is not adversely affected. If the suede artificial leather is intended to be dyed to colors quite different from the colors developed by the pigments in the superfine fiber and elastomeric polymer A, a large amount of dye is needed thereby to likely deteriorate the color fastness to light. Therefore, the coloring with dye, if employed, is preferably carry out after coloring the suede artificial leather to colors close to the intended colors by incorporating the pigments into the superfine fiber and elastomeric polymer A while using a required minimum amount of dye, for example, about 0 to 2% by mass of the superfine fiber or both the superfine fiber and elastomeric polymer A for obtaining light colors, or about 0 to 5% by mass of the superfine fiber or both the superfine fiber and elastomeric polymer A for obtaining deep colors. The suede artificial leather may be colored with a pigment for exhaustion coloring, if the effect of the present invention is not adversely affected.

In any event, a wide range of colors can be attained in the present invention without dyeing, because both the superfine fiber and elastomeric polymer A are colored with pigments, the organic pigments are mainly used as the pigments, and the color development of the elastomeric polymer A is ensured by regulating the average raised nap length of surface superfine fiber within a relatively short range of 10 to 200 μm.

On the basis of the above, the inventors have reached the method for obtaining a suede artificial leather excellent in the color development and the color fastness to light in a wide range of colors and excellent in the suede feeling, surface touch and hand.

The production method of the suede artificial leather of the present invention will be described in detail.

The superfine fiber-forming fiber usable in the present invention may include a sea-island composite fiber and a mix-spun composite fiber which are fibrillated into the superfine fiber by removing a component soluble to water or organic solvents, and also include a multicomponent composite fiber such as a separable and splittable composite fiber which is fibrillated into the superfine fiber by splitting treatment, with the sea-island composite fiber and the mix-spun composite fiber being preferred because the superfine fiber of 0.2 dtex or less can be easily obtained.

The superfine fiber-forming fiber is usually drawn after extruded from a spinning nozzle. The drawing may be carried out before or after winding the extruded fiber by using hot air, hot plate, hot roller, water bath, etc. If a highly water-soluble polymer such as a modified PVA is used, the drawing is preferably carried out by a dry method in hot air rather than in a water bath to minimize the affect of water. After optional treatments such as a crimp treatment, the superfine fiber-forming fiber is made into a web (fiber-entangled nonwoven fabric) comprising a short fiber having a fineness of 1 to 15 D (denier) and a fiber length of 2 to 80 mm. The web may be produced by know methods such as a method where a carded superfine fiber-forming fiber is passed through a webber to form a random web or a crosslap web which is then subjected to a needle punching treatment, and a method where a web prepared by a paper-making method is hydroentangled. Alternatively, a long fiber web produced by a known method such as a spun bonding method may be subjected to, if desired, a needle punching treatment or a hydroentangling treatment.

The web may be mixed or laminated with another fiber as far as the objects and effects of the present invention are not adversely affected. It is also preferred to provide or laminate a knitted fabric or a woven fabric to the inside of the web or on the back side opposite to the nap-raised surface as a support for stabilizing the shape.

Since both the superfine fiber and elastomeric polymer A are colored with the pigments, the present invention can be equally applicable to fibrous materials comprising fibers with different dyeing properties to which the conventional dyeing methods are difficult to be applied, for example, applicable to fibrous materials comprising fibers with different finenesses and fibrous materials comprising fibers made of polymers having different dyeing properties such as polyester, nylon and polypropylene. Thus, the present invention is applicable to the artificial leathers for a wide range of applications. Of the suede artificial leather made of different fibers, preferred are a suede artificial leather comprising a three-dimensional entangled body having a nonwoven fabric on its surface layer and a knitted or woven pigmented fabric on the back side of the nonwoven fabric, and a suede artificial leather comprising a three-dimensional entangled body having its surface layer and the back side being constituted by different fibers which are pigmented to similar colors, because their mechanical properties, hand and various functions can be easily controlled. The "different fibers" referred to herein means fibers different in the type of polymer and the fineness.

The different fibers and the knitted or woven fabric to be provided on the back side may contain, if desired, various additives such as discoloration inhibitors, heat stabilizers, flame retardants, lubricants, stain resistance agents, fluorescent brighteners, delusterants, coloring agents (colorants) , gloss improvers, antistatic agents, aromatizing agents, deodorants, antibacterial agents, miticides and inorganic fine particles. The knitted or woven fabric may be constituted, if desired, by the same superfine fiber-forming fiber as used in the present invention.

The fiber-entangled nonwoven fabric may be subject to shrinking, if desired, by a heat treatment at 50 to 200° C. or a hot water treatment in a hot water bath of 50 to 95° C. The shrinkage percentage may be suitably selected according to the type of superfine fiber-forming fiber, the mass ratio, spinning conditions and drawing conditions, and preferably 5 to 60%, more preferably 10 to 50% in terms of areal shrinkage, because the resultant suede artificial leather is excellent in the exterior appearance, surface smoothness and dense feeling.

The fiber-entangled nonwoven fabric may be tentatively fixed by a water-soluble sizing agent made of a resin removable by dissolution such as polyvinyl alcohol-based resins, or may be subjected to heat treatment such as hot press to regulate the surface smoothness and density.

The thickness of the fiber-entangled nonwoven fabric is not critical and can be arbitrarily selected depending on the applications of the resultant suede artificial leather, and preferably about 0.2 to 10 mm, more preferably about 0.4 to 5 mm. The density is preferably 0.20 to 0.80 g/cm$^3$, more preferably 0.30 to 0.70 g/cm$^3$. If lower than 0.20 g/cm$^3$, the feeling of nap-raising is insufficient and the mechanical properties are likely to be deteriorated. If higher than 0.80 g/cm$^3$, the resultant suede artificial leather becomes hard in its hand.

Then, the fiber-entangled nonwoven fabric is impregnated with an aqueous dispersion containing the water-dispersed elastomeric polymer A made of the urethane polymer, acryl polymer or acryl-urethane composite polymer and the water-dispersed pigment B. The water-dispersed elastomeric polymer is dry-coagulated by heat treatment or heat-sensitively coagulated by heat treatment, infrared heat treatment, hot water treatment or steam treatment, and then dried by heating. The elastomeric polymer A containing the pigment B may be uniformly provided throughout the fiber-entangled nonwoven fabric or may be provided with gradient in the thickness direction by the migration towards the surface or the back surface. In view of the uniform distribution of the pigment, it is preferred to provide the elastomeric polymer A uniformly throughout the fiber-entangled nonwoven fabric by a known heat-sensitive gelation method, for example, by a method where the elastomeric polymer A is coagulated by gelation in the presence of a heat-sensitive gelling compound in a hot water or a wet atmosphere or using infrared ray, microwave or hot air. The inclusion of the water-dispersed elastomeric polymer throughout the fiber-entangled nonwoven fabric can be effected by a known method which is capable of impregnating an aqueous dispersion of the elastomeric polymer A uniformly into the fiber-entangled nonwoven fabric, preferably by a method where the impregnated amount of the water-dispersed elastomeric polymer is regulated into a proper amount by press rolls or doctor knife after immersing the fiber-entangled nonwoven fabric in the aqueous dispersion, or by a coating method using a metering pump.

In another applicable method, a mixture of a solution of the elastomeric polymer A in an organic solvent and a solution or dispersion of the pigment B in an organic solvent is impregnated into the fiber-entangled nonwoven fabric, and then the elastomeric polymer A is wet-coagulated by a known method. However, extreme care must be taken to avoid the elution of the pigment.

The impregnation of the elastomeric polymer A containing the pigment B is preferably conducted at any stage after the step of producing the fiber-entangled nonwoven fabric from the superfine fiber-forming fiber and before the step of fibrillating the superfine fiber-forming fiber into fibers of 0.2 dtex or less, because a high-quality suede artificial leather excellent in the suede feeling, surface touch and flexibility, and also excellent in the practical performance such as the tear strength and color fastness to rubbing can be obtained.

If desired, it is preferred to continuously or discontinuously provide a layer of the elastomeric polymer B containing 0.5 to 25% by mass of the pigment C on the surface around the foots of the raised fibers, because the colors, color development, feeling of the surface and surface properties of the resultant suede artificial leather can be easily controlled. The amount to be provided is preferably 0.5 to 30 g/m$^2$, more preferably 1 to 20 g/m$^2$ on the solid basis of the elastomeric polymer B and the pigment C in view of obtaining a good color development and suede feeling of the surface. The elastomeric polymer B containing the pigment C may be provided to the surface portion of the fiber-entangled nonwoven fabric or the superfine fiber-entangled body by a known discontinuous coating method such as a gravure coating and a spray coating or a known continuous coating method such as a knife coating and a transfer coating, with the gravure coating and the spray coating being preferred because a uniform coating is obtained, the control of the coating amount is easy, and the suede feeling of the surface is not deteriorated. The elastomeric polymer A can be used as the elastomeric polymer B, and the pigment B can be used as the pigment C. These are preferably used as the water-dispersed elastomeric polymer and the water-dispersed pigment, because the color fastness to light, color fastness to rubbing and color development are improved. It is preferred for the elastomeric polymer B containing the pigment C to partly penetrate into the inside of the fiber-entangled nonwoven fabric or the superfine fiber-entangled body rather than provided only on the surface thereof, because the suede feeling, surface touch and peel strength of the resultant suede artificial leather are improved.

The step for providing the elastomeric polymer B containing the pigment C may be conducted at any stage after the step of providing the elastomeric polymer A to the fiber-entangled nonwoven fabric, and preferably before the step of fibrillating the superfine fiber-forming fiber into the superfine fiber or before the step of dyeing with a small amount of dye, if employed, because the suede feeling, surface touch and fastness such as color fastness to rubbing are improved.

The elastomeric polymer B containing the pigment C may further contain, if desired, penetrants, thickening agents, antioxidants, ultraviolet absorbers, film-forming aids, heat-sensitive gelling agents, softening agents, lubricants, stain resistance agents, fluorescent agents, antibacterial agents, flame retardants, water-soluble polymers such as polyvinyl alcohol and carboxymethylcellulose, dye, etc., as far as the effect of the present invention is not adversely affected Next, the superfine fiber-forming fiber in the fiber-entangled nonwoven fabric is fibrillated into superfine fiber by removing the extractable component of the superfine fiber-forming fiber by extraction with a solvent which dissolves the extractable component but is a non-solvent to the superfine fiber and the elastomeric polymer, or by subjecting the superfine fiber-forming fiber to a separating and splitting treatment if the superfine fiber-forming fiber is the separable and splittable composite fiber. In the present invention, it is particularly preferred to carry out the removal by extraction for the fibrillation in water or an aqueous solution substantially free from organic solvents, because, as described above, a wide range of pigments including organic pigments can be used; the superfine fiber component and elastomeric polymer component are not decomposed during the removal by extraction; the process is environment-friendly; and, if the extractable component is PVA, the shrinking action of PVA causes the structural crimps of superfine fibers to make the nonwoven fabric bulky and dense, thereby producing a suede artificial leather easily developed to brilliant colors and having flexible, natural leather-like excellent feeling. The water or the aqueous solution for use in the fibrillation treatment may be usually a soft water, and a weak alkaline or acidic aqueous solution is also usable. A surfactant or a penetrant may be contained. The temperature for the removal by extraction may be suitably selected taking the productivity into account, and preferably 50° C. or higher. The fibrillation process of the superfine fiber-forming fiber is preferably conducted after providing the elastomeric polymer A into the fiber-entangled nonwoven fabric. If the elastomeric polymer A is impregnated into the fiber-entangled nonwoven fabric after the fibrillation of the superfine fiber-forming fiber, the nap-raised feeling of the surface fiber is poor to likely deteriorate the suede feeling and surface touch and make the hand hard. In addition, the emulsifier or oligomer contained in the elastomeric polymer A or pigment B remains to deteriorate the color fastness to rubbing and cause the fogging in some cases. The elastomeric polymer A may adhere to the superfine fiber, or may be apart from the superfine fiber to form spaces therebetween. When the elastomeric polymer A and the superfine fiber partly bonded to each other, the suede feeling, surface touch, hand, surface strength, tear strength, and color fastness to rubbing are likely to be improved.

Before or after the fibrillation process of the superfine fiber-forming fiber, the thickness of the fiber-entangled nonwoven fabric can be regulated by heating under pressure or slicing in the direction perpendicular to the thickness direction. After the fibrillation process, at least one surface is subjected to the nap-raising treatment such as a buffing treatment to regulate the average raised nap length of the superfine fiber on at least one of the surfaces of the resultant suede artificial leather within 10 to 200 μm. To attain the average raised nap length of 10 to 200 μm, it is preferred, as described above, to control the ratio of the elastomeric polymer A to the three-dimensional entangled body to 15:85 to 60:40 by mass, and to use the elastomeric polymer A having a hot water swelling rate of 20% or less when measured immediately after immersion into a hot water of 130° C. It is also preferred to suitably select the buffing conditions of contact buffing, emery buffing, etc. such as the grain size of paper and the number of rotation.

In the present invention, the coloring may be carried out by a method where the suede artificial leather is colored to the indented colors by incorporating the pigments into the superfine fiber and elastomeric polymer A, or a method where the suede artificial leather is first colored closely to the intended colors and then the elastomeric polymer B containing the pigment C is provided to the surface around the foots of the raised superfine fibers, thereby matching the colors or controlling the color tones. In addition, the suede artificial leather may be further dyed with a small amount of dye to control the color tones, as far as the effect of the present invention is not adversely affected. Further, the suede artificial leather may be colored with a pigment for the exhaustion coloring unless adversely affect the effects of the present invention. If the dyeing is employed, sufficient care must be taken not to adversely affect the effects of the present invention such as color fastness to light, color fastness to rubbing, suede feeling, surface touch, hand, etc.

If desired, the suede artificial leather may be subject to a finish treatment such as flexibilizing treatment by crumpling, reverse seal brushing treatment, emery buffing treatment, antifouling treatment, hydrophilic treatment, lubricant treatment, softener treatment, antioxidant treatment, ultraviolet absorber treatment, fluorescent treatment, flame retardant treatment, etc.

It is preferred for the suede artificial leather to have a color fastness to light corresponding to fourth rating or higher when measured by irradiating the surface having nap-raised superfine fiber with a xenon arc lamp light under the conditions of a black panel temperature of 83° C. and an accumulated irradiated illuminance of 20 MJ, in view of attaining a good color fastness to light and color development in a wide range of colors.

It is also preferred for the suede artificial leather to have a color fastness to rubbing under wet conditions corresponding to third rating or higher when measured according to JIS L 0801, because the suede artificial leather suitable for use in interior applications such as car seat and clothing applications can be obtained. If light colors are intended, the color fastness to rubbing under wet conditions is preferably fourth rating or higher.

The suede artificial leather of the present invention may be made, if desired, into a grained artificial leather, a semi-grained artificial leather or a nubuck artificial leather, for example, by providing an elastomeric polymer C to at least one surface thereof in a known manner. Alternatively, the surface of the suede artificial leather is smoothed by pressing under heating to melt the surface portion thereof, which is then changed into a resinous covering layer to provide the grained artificial leather. The elastomeric polymer A is preferably used as the elastomeric polymer C to be provided into the surface in the production of the grained artificial leather, etc. When the elastomeric polymer and pigment of the same types as those contained in the inside of the suede artificial leather are used, the color fastness to light, color fastness to rubbing and color development are likely to be improved. In the production of the grained artificial leather, at least one surface of the suede artificial leather is completely covered with the elastomeric polymer C in a known manner. In the production of the semi-grained artificial leather, the grained portion is partially formed at least one surface of the suede artificial leather by providing the elastomeric polymer C by a known method such as spraying coating and gravure coating so as to make the ratio of the grained portion to the raised portion of superfine fiber within intended range. In the production of the nubuck artificial leather, the elastomeric polymer C is provided to at least one surface of the suede artificial leather in a known manner so as to shorten the raised nap length, and thereafter the buffing under mild conditions may be further conducted. In addition, the nubuck artificial leather may be produced by increasing the ratio by mass of the elastomeric polymer to the three-dimensional entangled body on its surface.

If desired, the suede artificial leather of the present invention may be adhesively laminated with an underlying knitted fabric or woven fabric, or with an underlying layer comprising a fiber different from the fiber constituting the suede artificial leather, each in a known manner. The laminated suede artificial leather may be subject to, if desired, a finish treatment such as flexibilizing treatment by crumpling, lubricant treatment, softener treatment, antioxidant treatment, ultraviolet absorber treatment, fluorescent treatment, flame retardant treatment, antifouling treatment, hydrophilic treatment, etc.

With its excellent color development and fastness such as color fastness to light in a wide variety of colors, comfortable feeling such as suede feeling, surface touch and hand, and high mechanical properties such as surface strength, tear strength and tensile strength, the suede artificial leather is suitable for use in car seat and interior products which are required to be highly resistant to light, and also suitable for use in clothing, apparels, shoes, bags, gloves, etc.

The present invention is described in more detail with reference to the examples. However, it should be noted that the following examples are merely illustrative and not limit the scope of the invention thereto. Unless otherwise noted, the "part" and "%" used in the examples are based on mass.

Tensile Strength

Measured according to 5.12.1 of JIS L 1079 on 25-mm wide samples cut out along the machine direction (MD) and the cross direction (CD), and expressed by the average of the measured values.

Tear Strength

Measured according to 5.14 (Method C) of JIS L 1079 on 25-mm wide samples cut out along the machine direction (MD) and the cross direction (CD), and expressed by the average of the measured values.

Color Fastness to Light

The surface of a suede artificial leather was irradiated with xenon arc lamp light for 100 h (black panel temperature=83° C.; accumulated irradiated illuminance=20 MJ/$m^2$; no water spray). The color change was evaluated according to the color change gray scale of JIS L 0804 to determine the degree of color change, and the rank of the degree was used as the rank of rating for the color fastness to light.

Color Fastness to Rubbing under Wet Conditions

Measured according to JIS L 0801 under wet conditions to evaluate by the rating.

Surface Abrasion

The weight loss was measured according to JIS L 1096 (Martindale method of 6.17.5E) under a press load of 12 kPa (gf/$cm^2$) and 50,000 times of abrasion.

Average Particle Size of Water-Dispersed Pigment

The results of the measurement by a dynamic light scattering method using "ELS-800" available from Otsuka Chemical Co., Ltd. were analyzed by the cumulant method described in "Experimental Method for Colloid Chemistry", Colloid Chemistry, vol. 4, Tokyo Kagaku Dojin.

Average Particle Size of Water-Dispersed Elastomeric Polymer

The results of the measurement by a dynamic light scattering method using "ELS-800" available from Otsuka Chemical Co., Ltd. were analyzed by the cumulant method described in "Experimental Method for Colloid Chemistry", Colloid Chemistry, vol. 4, Tokyo Kagaku Dojin. The average particle size of the elastomeric polymer in the suede artificial leather was measured as follows. After embedded in an epoxy resin and dyed, the suede artificial leather thus treated was sliced into an extremely thin film of 5 to 10 μm thick by a super microtome. Then the elastomeric polymer in the film was observed under a transmission electron microscope "H-800NA" available from Hitachi, Ltd. to determine the average particle size thereof.

Average Raised Nap Length of Suede Artificial Leather

A suede artificial leather dyed with osmium oxide was cross-sectionally observed under a scanning electron microscope "S-2100" available from Hitachi, Ltd. (200 magnifications) to measure the length of the surface fiber raised over the elastomeric polymer layer at 10 or more points, and the results were averaged.

Average Particle Size and Distribution of Pigment in Elastomeric Polymer

A suede artificial leather dyed with osmium oxide was cross-sectionally observed under a scanning electron microscope "S-2100" available from Hitachi, Ltd. (2000 to 10000 magnifications) on 10 or more points to determine the average particle size and the distribution of the pigment in the elastomeric polymer.

Average Particle Size and Distribution of Pigment in Superfine Fiber

After embedded in an epoxy resin and dyed, the superfine fiber constituting the suede artificial leather thus treated was cross-sectionally sliced into an extremely thin film of 5 to 10 μm thick by a super microtome. Then the film was observed under a transmission electron microscope "H-800NA" available from Hitachi, Ltd. (10,000 to 100,000 magnifications) at 10 or more points to determine the average particle size and distribution of pigment in superfine fiber.

Melting Point of Thermoplastic Resin

Determined by measuring the endothermic peak by DSC (TA3000 available from Mettler Toledo Co., Ltd.), which appeared when a 10 mg sample in nitrogen atmosphere was heated to 250° C. at a temperature rise rate of 10° C./min, cooled to room temperature, and again heated to 250° C. at a temperature rise rate of 10° C./min.

Hot Water Swelling Rate of Elastomeric Polymer Film at 130° C.

Immediately after heat-treating a 10-cm square cast film of 50±5 μm thick of the elastomeric polymer at 120 to 150° C., the mass (W0) was measured. Then, immediately after immersing the film in a hot water of 130° C. for one hour, the mass (W) was measured. The hot water swelling rate was calculated from the following formula:

$$\text{Hot water swelling rate at 130° C. } (wt\%)=[(W-W0)/W0]\times 100.$$

Transparency of Elastomeric Polymer Film

After heat-treating a 10-cm square cast film of 50±5 μm thick of the elastomeric polymer at 120 to 150° C., the transparency of the cast film was visually evaluated.

Preparation of Water-Soluble Thermoplastic Polyvinyl Alcohol

PREPARATION EXAMPLE 1

Into a 100-L pressure reactor equipped with a stirring device, a nitrogen inlet, an ethylene inlet and an opening for adding an initiator, were charged 29.0 kg of vinyl acetate and 31.0 kg of methanol. After raising the temperature to 60° C., the reaction system was replaced with nitrogen by bubbling nitrogen for 30 min. Then, ethylene was introduced into the reactor until the pressure reached 5.9 kg/cm$^2$. Separately, a 2.8 g/L initiator solution of 2,2'-azobis(4-methoxy-2,4-dimethylvaleronitrile) (AMV) in methanol was replaced with nitrogen by nitrogen gas bubbling. The polymerization was initiated by adding 170 mL of the initiator solution into the reactor after adjusting the inside temperature thereof to 60° C. The polymerization was allowed to proceed while continuously adding the initiator solution at a rate of 10 mL/h while maintaining the reactor pressure at 5.9 kg/cm$^2$ and the polymerization temperature at 60° C. After 10 hr, the polymerization rate reached 70% and the polymerization was terminated by cooling. After releasing ethylene by opening the reactor, the reaction product was bubbled with nitrogen gas to complete the removal of ethylene. Then, the unreacted vinyl acetate monomer was removed under reduced pressure to obtain a methanol solution of polyvinyl acetate. After adjusting the concentration to 50% by adding methanol, 200 g of methanol solution of polyvinyl acetate (containing 100 g of polyvinyl acetate) was added with 46.5 g of an alkali solution (10% methanol solution of sodium hydroxide), corresponding to 0.10 mol of alkali per one mole of the vinyl acetate unit of the polyvinyl acetate. After about 2 min of the addition of the alkali solution, the reaction system began to gel. After disintegrating the gelled product in a crusher, the saponification was proceeded by allowing to stand at 60° C. for one hour. Then, the remaining alkali was neutralized with 1000 g of methyl acetate. After confirming the end of neutralization with phenolphthalein indicator, the neutralized product was filtered to separate a white solid (PVA) which was washed by adding 1000 g of methanol and allowing to stand at room temperature for 3 hr. After repeating the washing operation three times, the washed PVA was centrifuged to remove liquid and dried in a drier at 70° C. for two days to obtain an ethylene-modified PVA.

The saponification degree of the ethylene-modified PVA was 98.4 mol %. The content of alkali metal ion in terms of sodium ion was 0.03% by mass based on 100 parts by mass of the ethylene-modified PVA when measured by an atomic-absorption spectrometry on an acid solution of ash of the ethylene-modified PVA. The methanol solution of polyvinyl acetate obtained by removing the unreacted vinyl acetate monomer after the polymerization was added to n-hexane, and the resultant precipitates were purified by repeating the re-precipitation from acetone three times and vacuum-dried at 80° C. for three days to obtain a purified polyvinyl acetate. The analysis of a d6-DMSO solution of the purified polyvinyl acetate by 500 MHz $^1$H-NMR at 80° C. using JEOL GX-500 NMR apparatus showed that the ethylene content was 10 mol %. The methanol solution of polyvinyl acetate was added with an alkali in a proportion of 0.5 mol per one mole of the vinyl acetate unit. After disintegrating the resultant gel-like product, the saponification was proceeded by allowing it to stand at 60° C. for 5 hr and the resultant product was subjected to Soxhlet extraction with methanol for three days. The extracted product was vacuum-dried at 80° C. for three days to obtain a purified ethylene-modified PVA. The polymerization degree of the purified ethylene-modified PVA was 330 when measured by a usual method according to JIS K 6726. The content of 1,2-glycol bonding and the content of the central hydroxyl group of the three successive vinyl alcohol unit chain of the purified ethylene-modified PVA were respectively 1.50 mol % and 83 mol % when measured by 500 MHz $^1$H-NMR (JEOL GX-500) in the manner described above. In addition, a cast film with 10 μm thick was prepared from a 5% aqueous solution of the purified ethylene-modified PVA. After vacuum-drying the film at 80° C. for one day, the analysis by using a DSC (TA3000 available from Mettler Toledo Co., Ltd.) in the manner described above showed that the melting point was 206° C. Next, a PVA blend was prepared by blending a sorbitol-ethylene oxide adduct (1:2 by mol) in an amount of 5% by mass of the ethylene-modified PVA in a twin-screw extruder.

Production of Artificial Leather

EXAMPLE 1

Using the 10 mol % ethylene-modified PVA (melting point: 206° C.) prepared in Preparation Example 1 as the island component, and using as the sea component a polyethylene terephthalate chip (melting point: 234° C.) copolymerized with 8 mol % of isophthalic acid (hereinafter may be referred to as "IPA") which contained 2.0% by mass of carbon black and had a intrinsic viscosity of 0.65 when measured in a phenol/tetrachloroethane equiamount (by mass) solution at 30° C., the island component and the sea component were extruded from a composite melt-spinning nozzle into a spun fiber at 240° C. so as to have a ratio of the island component to the sea component of 60:40 by mass and an island number of 36. The spun fiber was drawn by a roller plate method under usual conditions to obtain a multifilament of 70 dtex/24 filaments. The spinnability, continuous running properties and drawability were good with no problem. The sea-island superfine fiber-forming fiber was mechanically crimped, cut into 51-mm length, carded, and then made into a web by a crosslap webber. The web was needle-punched at a rate of 1500 punch/cm$^2$ to be made into a fiber-entangled nonwoven fabric having a 600 g/m$^2$ mass per unit area, which was then dry-heated at 175° C. to shrink by 30% on area basis and press-treated by a hot press roll under usual conditions to make the surface smooth. The average fineness of the superfine fiber-forming fiber thus obtained was 3.5 dtex. Separately, a water-dispersed pigment and a water-dispersed elastomeric polymer were mixed in a solid ratio of 4/96 by mass, while using as the water-dispersed pigment a gray water-dispersed pigment ("Sandye Super" available from Sanyo Color Works, Ltd.; condensed polycyclic blue pigment: condensed polycyclic red pigment: carbon black=45:50:5 by mass on solid basis; average particle size=0.2 μm), and using as the water-dispersed elastomeric polymer a water-dispersed polyurethane emulsion ("Super Flex E-4800" available from Dai-Ichi Kogyo Seiyaku Co., Ltd.; hot water swelling rate at 130° C. of cast film=8%; average particle size=0.2 μm; transparency of cast film=good; color fastness to light of cast film=fourth to fifth rating) which mainly comprised a polyol, a non-yellowing diisocyanate, an amine-based chain extender and a polyfunctional compound. After adding 0.5 part by mass of sodium sulfate as a heat-sensitive gelling agent to 100 parts by mass of the aqueous mixed dispersion, the water-dispersed polyurethane emulsion containing the pigment was impregnated into the fiber-entangled nonwoven fabric in a solid ratio of 30/70 based on the polyester component, followed by a pre-drying in a medium infrared heater and a drying in a hot air dryer at 150° C.

The fiber-entangled nonwoven fabric after the impregnation treatment was sliced into two parts by a slicer along the direction perpendicular to the thickness direction. The non-sliced surface was buffed by a sand paper to adjust the thickness to 0.80 mm, and the sliced surface was raised by an emery buffing machine to form a nap-raised surface. Then, the 10 mol % ethylenemodified PVA as the sea component was removed by extraction with a 90° C. hot water using a liquid circulator, and simultaneously, a relaxation treatment was done. Finally, the nap-raised surface was finished by a reverse seal to obtain a gray suede artificial leather wherein the thickness was 0.80 mm, the density was 0.55 g/cm$^3$, the ratio of the elastomeric polymer to the three-dimensional entangled body was 30/70 by mass, and the fineness of the superfine fiber was 0.06 dtex. The obtained suede artificial leather was of high quality excellent in any of the color development, suede feeling, surface touch and hand. The fastness and mechanical properties were also excellent, with a color fastness to light of fourth to fifth rating, a color fastness to rubbing under wet conditions of fourth rating, a tensile strength of 40 kg/2.5 cm, a tear strength of 5.0 kg, and a weight loss in the surface abrasion test of 40 mg. The observation under a scanning electron microscope showed that the pigment was dispersed substantially uniformly throughout the elastomeric polymer as a particle having an average particle size of 0.1 to 0.2 μm and embedded almost completely by the elastomeric polymer. The average raised nap length of the surface fiber was about 80 μm. The observation under a transmission electron microscope showed that the carbon black in the superfine fiber was dispersed substantially uniformly throughout the polyester resin as a particle having an average particle size of about 0.08 μm and embedded almost completely by the polyester resin.

EXAMPLE 2

A dark gray suede artificial leather was produced in the same manner as in Example 1, except that, before the fibrillation by extraction, an aqueous dispersion of 5% solid content, which was prepared by mixing the gray water-dispersed pigment and the water-dispersed polyurethane emulsion each used in Example 1 in a solid ratio of 10:90 by mass, was coated on the surface of the fiber-entangled nonwoven fabric in a coating amount of 5 g/m$^2$ on solid basis by a 200-mesh gravure coater and solidified by drying. The obtained suede artificial leather was excellent in the darkness of color, suede feeling, surface touch and hand. In addition, the color fastness to light was as high as fourth to fifth rating, the color fastness to rubbing under wet conditions was as high as fourth rating, and the weight loss in the surface abrasion test was as small as 30 mg. The average raised nap length of the surface fiber was about 40 μm.

EXAMPLE 3

A bluish gray suede artificial leather was produced in the same manner as in Example 1, except that the polyvinyl alcohol copolymer as the sea component was removed by extraction with a 90° C. hot water using a liquid circulator simultaneously with a relaxation treatment, and then, the fiber-entangled nonwoven fabric was dyed with a bluish gray disperse dye at 130° C. in a fixing amount of 0.5% by mass of the fiber-entangled nonwoven fabric. The obtained suede artificial leather was excellent in any of the color development, suede feeling, surface touch and hand. The fastness and mechanical properties were also excellent, with a color fastness to light of fourth rating, a color fastness to rubbing under wet conditions of fourth rating, a tensile strength of 35 kg/2.5 cm, a tear strength of 4.5 kg, and a weight loss in the surface abrasion test of 45 mg. The average raised nap length of the surface fiber was about 100 μm.

EXAMPLE 4

A navy blue suede artificial leather was produced in the same manner as in Example 1, except that (1) 3% by mass of a condensed polycyclic blue pigment, in place of the carbon black, was incorporated into the 8 mol % IPA-modified polyethylene terephthalate which constituted the superfine fiber; (2) the water-dispersed elastomeric polymer was changed to a water-dispersed elastomeric polymer of acryl-polyurethane composite type having a multilayered structure formed by a polyurethane mainly comprising a polyether/polycarbonate polyol (60/40 by mol), a non-yellowing diisocyanate, an amine-based chain extender and a polyfunctional compound, and an acryl mainly comprising butyl methacrylate, methyl methacrylate and a polyfunctional compound (acryl: polyurethane=60:40 by mass; hot water swelling rate at 130° C.=8%; average particle size=0.3 μm; transparency of cast film=good; color fastness to light of cast film=fourth to fifth rating); and (3) the pigment to be incorporated into the elastomeric polymer was changed to a navy blue water-dispersed pigment ("Sandye Super" available from Sanyo Color Works, Ltd.; condensed polycyclic blue pigment: condensed polycyclic red pigment: carbon black=80:15:5 by mass on solid basis; average particle size=0.2 μm). The obtained suede artificial leather was excellent in any of the color brilliantness, suede feeling, surface touch and hand. The fastness and mechanical properties were also excellent, with a color fastness to light of fourth to fifth rating, a color fastness to rubbing under wet conditions of third to fourth rating, a tensile strength of 45 kg/2.5 cm, a tear strength of 5.0 kg, and a weight loss in the surface abrasion test of 40 mg. The observation under a scanning electron microscope showed that the pigment was dispersed substantially uniformly throughout the elastomeric polymer as a particle having an average particle size of 0.1 to 0.2 μm and embedded almost completely by the elastomeric polymer. The average raised nap length of the surface fiber was about 70 μm. The observation under a transmission electron microscope showed that the pigment in the superfine fiber was dispersed substantially uniformly throughout the polyester resin as a particle having an average particle size of about 0.07 μm and embedded almost completely by the polyester resin. In the elastomeric polymer, the polyurethane substantially formed the continuous phase. The average particle size of the elastomeric polymer was 0.2 to 0.3 μm and a major portion of the pigment presented in the polyurethane.

EXAMPLE 5

A bluish gray suede artificial leather was produced in the same manner as in Example 4, except that the water-soluble thermoplastic polyvinyl alcohol copolymer as the sea component was removed by extraction with a 90° C. hot water using a liquid circulator simultaneously with a relaxation treatment, and then, the fiber-entangled nonwoven fabric was dyed with a navy blue disperse dye at 130° C. in a fixing amount of 0.5% by mass of the fiber-entangled nonwoven fabric. The obtained suede artificial leather shoed a deeper color as compared with Example 4, and excellent in the color brilliantness, darkness of color, suede feeling, surface touch and hand. In addition, the color fastness to light was as high as fourth rating, the color fastness to rubbing under wet conditions was as high as third to fourth rating, the tensile strength was as high as 35 kg/2.5 cm, the tear strength was as high as 4.5 kg, and the weight loss in the surface abrasion test was as small as 45 mg. The average raised nap length of the surface fiber was about 90 μm when determined by the observation under a scanning electron microscope.

EXAMPLE 6

The fiber-entangled nonwoven fabric of a 250 g/m$^2$ mass per unit area comprising the same superfine fiber-forming fiber as used in Example 1 was underlaid with a tubular knitted fabric of a 150 g/m$^2$ mass per unit area comprising a core-sheath composite long fiber made of the same material as used for the superfine fiber of Example 1. In the core-sheath composite long fiber, the sheath was a 10 mol % ethylene-modified PVA, the core was a 8 mol % IPA-modified polyethylene terephthalate containing 0.2% by mass of carbon black, the sheath/core ratio was 40/60 by mass, and the average fineness of the superfine fiber was 2 dtex. The resultant laminate was needle-punched at a rate of 1500 punch/cm$^2$ to prepare a fiber-entangled nonwoven fabric. Then, according to the same procedure as in Example 1 except for changing the ratio of the elastomeric polymer to the three-dimensional entangled body to 25/75 and omitting the slicing treatment, a gray suede artificial leather having a thickness of 0.70 mm and a density of 0.60 g/cm$^3$ was produced. The obtained suede artificial leather was excellent in the color development, suede feeling, surface touch, flexibility and draping properties. The fastness and mechanical properties were also excellent, with a color fastness to light of fourth to fifth rating, a color fastness to rubbing under wet conditions of fourth rating, a tensile strength of 50 kg/2.5 cm, a tear strength of 6.0 kg, and a weight loss in the surface abrasion test of 50 mg. The average raised nap length of the surface fiber was about 100 μm.

EXAMPLE 7

A beige suede artificial leather was produced in the same manner as in Example 1 except for changing the carbon black content in the superfine fiber to 0.2% by mass, the pigment in the elastomeric polymer to a water-dispersed beige pigment ("Sandye Super" available from Sanyo Color Works, Ltd.; insoluble yellow azo pigment: condensed polycyclic red pigment: titanium oxide white pigment=80:15:5 by mass on solid basis; average particle size=0.2 μm), and the ratio of the pigment in the elastomeric polymer to the elastomeric polymer to 2/98 by mass. The obtained suede artificial leather was excellent in the suede feeling, surface touch and hand. The fastness and mechanical properties were also excellent, with a color fastness to light of fourth to fifth rating, a color fastness to rubbing under wet conditions of fourth to fifth rating, a tensile strength of 50 kg/2.5 cm, a tear strength of 5.5 kg, and a weight loss in the surface abrasion test of 40 mg. The observation under a scanning electron microscope showed that the pigment was dispersed substantially uniformly throughout the elastomeric polymer as a particle having an average particle size of 0.1 to 0.2 μm and embedded almost completely by the elastomeric polymer. The average raised nap length of the surface fiber was about 80 μm. The observation under a transmission electron microscope showed that the pigment in the superfine fiber was dispersed substantially uniformly throughout the polyester resin as a particle having an average particle size of about 0.07 μm and embedded almost completely by the polyester resin.

EXAMPLE 8

A brown suede artificial leather was produced in the same manner as in Example 2 except for changing the island component of the superfine fiber-forming fiber to nylon 6 ("Ube Nylon 1013BK" available from Ube Industries, Ltd.; melting point=222° C.); the number of islands to 100; the pigment to be incorporated into the superfine fiber to a condensed polycyclic red pigment (3% by mass); the pigment to be incorporated into the elastomeric polymer to a water-dispersed brown pigment ("Sandye Super" available from Sanyo Color Works, Ltd.; insoluble yellow azo pigment: condensed polycyclic red pigment: carbon black=80:15:5 by mass on solid basis; average particle size=0.2 μm); and the pigment to be coated to the surface of the fiber-entangled nonwoven fabric to a water-dispersed brown pigment ("Sandye Super" available from Sanyo Color Works, Ltd.; insoluble yellow azo pigment: condensed polycyclic red pigment: carbon black=80:15:5 by mass on solid basis; average particle size=0.2 μm). The obtained suede artificial leather contained the superfine fiber having an average fineness of 0.02 dtex, and was excellent in the suede feeling, surface touch and hand. The fastness and mechanical properties were also excellent, with a color fastness to rubbing under wet conditions of third to fourth rating, a tensile strength of 45 kg/2.5 cm, a tear strength of 5.0 kg, and a weight loss in the surface abrasion test of 35 mg. The observation under a scanning electron microscope showed that the pigment was dispersed substantially uniformly throughout the elastomeric polymer as a particle having an average particle size of about 0.2 μm and embedded almost completely by the elastomeric polymer. The average raised nap length of the surface fiber was about 40 μm. The observation under a transmission electron microscope showed that the organic brown pigment in the superfine fiber was dispersed substantially uniformly throughout the nylon resin as a particle having an average particle size of about 0.05 μm and embedded almost completely by the nylon resin.

EXAMPLE 9

A brown suede artificial leather was produced in the same manner as in Example 8 except for changing the island component of the superfine fiber-forming fiber to polypropylene ("Idemitsu Polypro Y-3002G" (melting point: 168° C) available from Idemitsu Kosan Co., Ltd.). The obtained suede artificial leather was excellent in the color development, suede feeling, surface touch and hand. The fastness and mechanical properties were also excellent, with a color fastness to rubbing under wet conditions of fourth rating, a tensile strength of 40 kg/2.5 cm, a tear strength of 4 kg, and a weight loss in the surface abrasion test of 60 mg. Particularly, the suede artificial leather was excellent in its light weight. The average raised nap length of the surface fiber was about 150 μm. The observation under a transmission electron microscope showed that the pigment in the superfine fiber was dispersed substantially uniformly throughout the polypropylene as a particle having an average particle size of about 0.08 μm and embedded almost completely by the polypropylene.

COMPARATIVE EXAMPLE 1

A suede artificial leather was produced in the same manner as in Example 1 except for changing the content of carbon black in the superfine fiber to 10% by mass. The obtained suede artificial leather was poor in its fastness and mechanical properties, with a color fastness to rubbing under wet conditions of first rating, a tensile strength of 10 kg/2.5 cm, a tear strength of 1 kg, and a weight loss in the surface abrasion test of 150 mg or more. The spinnability was also poor because of frequent breaking in the spinning process. The observation under a scanning electron microscope showed the presence of a large amount of coarse particles of carbon black having a particle size exceeding 0.5 μm, and the presence of a large amount of the carbon black particles not embedded in the superfine fiber.

COMPARATIVE EXAMPLE 2

The same procedure of Example 4 was repeated except for changing the pigment in the superfine fiber to an inorganic blue pigment, but the spinnability was poor because of frequent breaking in the spinning process. The obtained suede artificial leather was poor in the color brilliantness and color development, and also poor in the fastness and mechanical properties, with a color fastness to rubbing under wet conditions of first rating, a tensile strength of 10 kg/2.5 cm, a tear strength of 1 kg, and a weight loss in the surface abrasion test of 150 mg or more. The observation under a scanning electron microscope showed the presence of a large amount of coarse particles of the inorganic blue pigment having a particle size exceeding 1 μm with the average particle size of about 0.5 μm, and the presence of a large amount of the inorganic blue pigment particles not embedded in the superfine fiber.

COMPARATIVE EXAMPLE 3

A suede artificial leather was produced in the same manner as in Example 5 except for incorporating no pigment into the superfine fiber and disperse-dying the fiber-entangled nonwoven fabric with a navy blue disperse dye in an amount of 15% by mass of the superfine fiber by a circular dyeing machine at 130° C. In the obtained suede artificial leather, the fixing amount of the dye was about 8% by mass of the superfine fiber, and the color fastness to light was poor because as low as second rating.

COMPARATIVE EXAMPLE 4

A suede artificial leather was produced in the same manner as in Example 1 except for changing the number of the islands comprising the 8 mol % IPA-modified polyethylene terephthalate to 16, the fineness of the multifilament after drawing to 192 dtex/24 filaments, and the average fineness of the superfine fiber to 0.35 dtex. The obtained suede artificial leather showed marked color unevenness in the superfine fiber and the elastomeric polymer, and was poor in the sued feeling and surface touch, failing to attain a high quality.

COMPARATIVE EXAMPLE 5

A suede artificial leather was produced in the same manner as in Example 1 except for incorporating no pigment into the elastomeric polymer. The color unevenness was marked in the superfine fiber and the elastomeric polymer because of the whitened elastomeric polymer and the color development was poor, resulting in the lack of high quality.

COMPARATIVE EXAMPLE 6

A suede artificial leather was produced in the same manner as in Example 1 except for changing the ratio of the elastomeric polymer to the pigment therein to 65:35 by mass. The obtained suede artificial leather was poor in the fastness and mechanical properties, with a color fastness to rubbing under wet conditions of second rating, a tensile strength of 20 kg/2.5 cm, and a weight loss in the surface abrasion test of 150 mg. The observation under a scanning electron microscope showed the presence of a large amount of the pigment near the surface of the elastomeric polymer, indicating the presence of a large amount of the pigment particles not embedded in the elastomeric polymer.

COMPARATIVE EXAMPLE 7

The same procedure as in Example 4 was repeated except for changing the pigment to be incorporated into the elastomeric polymer to an inorganic blue pigment having a 0.8 μm average particle size, but the impregnation ability was poor because of the sedimentation of the pigment in the elastomeric polymer solution. The obtained suede artificial leather was poor in the fastness and mechanical properties, with a color fastness to rubbing under wet conditions of second rating, a tensile strength of 20 kg/2.5 cm, and a weight loss in the surface abrasion test of 150 mg. In addition, the color unevenness was significant in the machine direction and cross direction. The observation under a scanning electron microscope showed that the average particle size of the pigment in the elastomeric polymer was 0.7 to 0.8 μm and many of the pigment particles were not embedded by the elastomeric polymer.

COMPARATIVE EXAMPLE 8

A suede artificial leather was produced in the same manner as in Example 8 except for changing the ratio of the elastomeric polymer to the three-dimensional entangled body to 10:90 by mass. The average raised nap length of the superfine fiber in the resultant suede artificial leather was 300 μm or longer to completely hide the color of the elastomeric polymer, resulting in a poor color development. In addition, the color fastness to rubbing under wet conditions was as low as second rating, and also the weight loss in the surface abrasion test was as large as 150 mg.

COMPARATIVE EXAMPLE 9

A suede artificial leather was produced in the same manner as in Example 1 except for changing the ratio of the elastomeric polymer to the three-dimensional entangled body to 70:30 by mass. The obtained suede artificial leather lacked the suede feeling and poor in the surface touch. The mechanical properties were also poor, with a tensile strength as low as 10 kg/2.5 cm and a tear strength as low as 1 kg.

COMPARATIVE EXAMPLE 10

A suede artificial leather was produced in the same manner as in Example 1 except for incorporating no pigment into both the superfine fiber and the elastomeric polymer, coloring the fiber-entangled nonwoven fabric with a black pigment for exhaustion coloring ("Emacol CT Black" available from Sanyo Color Works, Ltd.) in an amount of 20% by mass of the fiber at 100° C. by a circular dyeing machine, and thereafter impregnating an acrylic water-dispersed elastomeric polymer into the fiber-entangled nonwoven fabric. Although the obtained suede artificial leather showed a good color fastness to light of fourth to fifth rating, the color fastness to rubbing was as low as second rating. The observation under a scanning electron microscope showed that the pigment was adhered to the surface of the superfine fiber and elastomeric polymer and little of the pigment was embedded in the superfine fiber and elastomeric polymer. The fixing ratio of the pigment to the superfine fiber was 15% by mass.

EXAMPLE 10

An aqueous dispersion of a water-dispersed elastomeric polymer of a solid concentration of 10% containing the gray water-dispersed pigment as used in Example 2 was coated on the suede artificial leather produced in Example 1 in a coating amount of 15 g/m$^2$ on solid basis by a 200-mesh gravure coater and solidified by drying. The suede artificial leather thus treated was then embossed at 165° C. to obtain a gray semi-grained artificial leather. In the obtained semi-grained artificial leather, the ratio of the grained portion to the raised fiber portion on the surface thereof is about 50/50, and the raised fiber and the elastomeric polymer were intermingled with each other to provide a good grained finish, surface touch and hand. The fastness and mechanical properties were also excellent, with a color fastness to light as high as fourth to fifth rating, a color fastness to rubbing under wet conditions as high as third to fourth rating, and a weight loss in the surface abrasion test as small as 30 mg. The average raised nap length of the surface fiber was about 40 μm.

EXAMPLE 11

The aqueous dispersion of a water-dispersed elastomeric polymer containing the gray water-dispersed pigment as used in Example 2 was diluted to a solid concentration of 20% and coated on the suede artificial leather produced in Example 1 in a coating amount of 50 g/m$^2$ on solid basis by a 50-mesh gravure coater and solidified by drying. The suede artificial leather thus treated was then embossed at 165° C. to obtain a grained artificial leather having a grained layer of 50 μm thick. In the obtained grained artificial leather, the grained layer formed an integral part of the grained artificial leather to provide an excellent hand. The color fastness to light was also as high as fourth to fifth rating.

What is claimed is:

1. A suede artificial leather comprising a three-dimensional entangled body comprising a superfine fiber having a fineness of 0.2 dtex or less and an elastomeric polymer A impregnated in the three-dimensional entangled body, the suede artificial leather satisfying the following requirements (1) to (4):

(1) a pigment A in an amount of 0.1 to 8% by mass is embedded in the superfine fiber, wherein the pigment A is at least one pigment selected from the group consisting of an organic pigment having an average particle size of 0.01 to 0.3 μm and carbon black having an average particle size of 0.01 to 0.3 μm;

(2) a pigment B in an amount of 1 to 20% by mass is embedded in the elastomeric polymer A, wherein the pigment B is at least one pigment selected from the group consisting of an organic pigment having an average particle size of 0.05 to 0.6 μm and carbon black having an average particle size of 0.05 to 0.6 μm, or the pigment B is a pigment particle having an average particle size of 0.05 to 0.6 μm which comprises a mixture of an organic pigment with carbon black or at least one inorganic pigment, wherein the elastomeric polymer A is selected from the group consisting of a polyurethane and an acryl-polyurethane composite elastomeric polymer, which is transparent when made into a cast film and has a hot water swelling rate of 20% or less when measured immediately after immersion to a hot water of 130° C.;

wherein the acryl-polyurethane composite elastomeric polymer is obtained by an emulsion polymerization of an ethylenically unsaturated monomer comprising a (meth)acrylic acid derivative and in the presence of an aqueous dispersion of a urethane resin and is crosslinked by copolymerizing a polyfunctional ethylenically unsaturated monomer selected from the group consisting of 1,6-hexanediol di(meth)acrylate, 1,9-nonanediol di(meth)acrylate, neopentyl glycol di(meth)acrylate, divinylbenzene and allyl (meth)acrylate;

wherein the polyurethane is obtained from the reaction of a diisocyanate component, a polymeric polyol component, a chain extender and a carboxyl group-containing diol and crosslinked with a crosslinking agent, wherein the diisocyanate component is an aliphatic diisocyanate or alicyclic diisocyanate and containing less than 10% by mass of an aromatic diisocyanate, wherein the aliphatic diisocyanate or alicyclic diisocyanate is selected from the group consisting of hexamethylene diisocyanate, isophorone diisocyanate, norbornene diisocyanate and 4,4'-dicyclohexylmethane diisocyanate;

wherein the polymeric polyol component of the polyurethane is selected from the group consisting of polyethylene glycol, polypropylene glycol, polytetramethylene glycol, poly(methyltetramethylene glycol), polybutylene adipate diol, polybutylene sebacate diol, polyhexamethylene adipate diol, poly(3-methyl-1,5-pentylene adipate) diol, poly(3-methyl-1,5-pentylerne sebacate) diol, polycaprolactone diol, polyhexamethylene carbonate diol, and poly(3-methyl-1,5-pentylene carbonate) diol;

wherein the chain extender is selected from the group consisting of hydrazine, ethylenediamine, propylenediamine, hexamethylenediamine, nonamethylenediamine, xylylenediamine, isophoronediamine, piperazine, adipoyldihydrazide, isophthaloyldihydazide, diethylenetriamine, triethylenetrimine, ethylene glycol, propylene glycol, 1,4-butanediol, 1,6-hexanediol, 1,4-bis(β-hydroxyethoxy)benzene, 1,4-cyclohexanediol, trimethylolpropane, pentaerythritol, aminoethyl alcohol and aminopropyl alcohol;

wherein the crosslinking agent reacts with the carboxyl group of the polyurethane and has oxazoline group, carbodiimide group, epoxy group, cyclocarbonate group, aziridine group or hydrazide group;

(3) the ratio of the elastomeric polymer A to the three-dimensional entangled body is 15:85 to 60:40 by mass; and (4) an average raised nap length of the superfine fiber present on the surface of the suede artificial leather is 10 to 200 μm.

2. The suede artificial leather according to claim 1, wherein the pigment A is at least one pigment selected from the group consisting of condensed polycyclic organic pigments, insoluble azo pigments and carbon black.

3. The suede artificial leather according to claim 1, wherein the pigment B contains at least one pigment selected from the group consisting of condensed polycyclic organic pigments and insoluble azo pigments.

4. The suede artificial leather according claim 1, wherein the elastomeric polymer A has a color fastness to light of third rating or higher when measured by an evaluation method of color fastness to xenon arc lamp light under conditions of a black panel temperature of 83° C. and an accumulated irradiated illuminance of 20 MJ.

5. The suede artificial leather according to claim 1, wherein the elastomeric polymer A is derived from a water-dispersed elastomeric polymer having an average particle size of 0.1 to 0.7 μm.

6. The suede artificial leather according to claim 1, wherein a surface of the suede artificial leather has a color fastness to light of fourth rating or higher when measured by an evaluation method of color fastness to xenon arc lamp light under conditions of a black panel temperature of 83° C. and an accumulated irradiated illuminance of 20 MJ.

7. The suede artificial leather according to claim 1, wherein a layer comprising an elastomeric polymer B containing 0.5 to 25% by mass of a pigment C is continuously or discontinuously disposed on a surface of the suede artificial leather around feet of nap-raised fibers.

8. The suede artificial leather according to claim 1, wherein a knitted fabric or a woven fabric is laminated in an inside or on a back surface of the three-dimensional entangled body.

9. A semi-grained artificial leather comprising a nap-raised superfine fiber with a mingling grained portion comprising an elastomeric polymer C, which is produced by partially covering at least one surface of the suede artificial leather as defined in claim 1 with an elastomeric polymer C.

10. A grained artificial leather produced by covering at least one surface of the suede artificial leather as defined in claim 1 with an elastomeric polymer C.

11. The suede artificial leather according to claim 1, wherein the pigment A is present in an amount of 0.1 to 2% by mass.

12. The suede artificial leather according to claim 1, wherein the pigment A is present in an amount of 1 to 5% by mass.

13. The suede artificial leather according to claim 1, wherein the pigment A is present in an amount of 0.2 to 5% by mass.

14. The suede artificial leather according to claim 1, wherein the pigment A is present in an amount of 0.5 to 4% by mass.

15. The suede artificial leather according to claim 1, wherein the elastomeric polymer A impregnates the three-dimensional entangled body uniformly.

16. The suede artificial leather according to claim 1, wherein the elastomeric polymer A impregnates the three-dimensional entangled body with a gradient in the thickness direction.

17. The suede artificial leather according to claim 1, wherein the pigment B is (1) at least one organic pigment selected from the group consisting of a condensed polycyclic organic pigment and an insoluble azo pigment; (2) a mixture of said at least one organic pigment and carbon black; or (3) a mixture of said at least one organic pigment and at least one inorganic pigment selected from the group consisting of titanium oxide, red iron oxide, chromium red, molybdenum red, litharge, ultramarine and iron oxide.

18. The suede artificial leather according claim 1, wherein the diisocyanate component contains no aromatic diisocyanate.

* * * * *